US006124852A

United States Patent [19]

Yamagishi et al.

[11] Patent Number: 6,124,852

[45] Date of Patent: Sep. 26, 2000

[54] LIQUID CRYSTAL DISPLAY APPARATUS AND METHOD FOR DRIVING THE SAME

[75] Inventors: Koji Yamagishi, Ome; Tatsuhiko Yonekawa, Fussa; Masanori Sakamoto, Hamura; Takahiro Nakada, Tanashi, all of Japan

[73] Assignee: Casio Computer Co., Ltd., Tokyo, Japan

[21] Appl. No.: 08/955,553

[22] Filed: Oct. 20, 1997

[30] Foreign Application Priority Data

Oct. 23, 1996 [JP] Japan ..... 8-280762

[51] Int. Cl.[7] ..... G09G 3/36

[52] U.S. Cl. ..... 345/209; 345/94; 345/96; 345/98; 345/100; 345/208

[58] Field of Search ..... 345/55, 58, 79, 345/103, 204–213, 93–96, 98, 100

[56] References Cited

U.S. PATENT DOCUMENTS

| | | | |
|---|---|---|---|
| 4,800,382 | 1/1989 | Okada et al. | 340/784 |
| 4,926,168 | 5/1990 | Yamamoto et al. | 345/58 |
| 5,093,655 | 3/1992 | Tanioka et al. | 345/96 |
| 5,184,118 | 2/1993 | Yamazaki | 340/784 |
| 5,517,207 | 5/1996 | Kawada et al. | 345/78 |
| 5,565,883 | 10/1996 | Shimizu | 345/94 |
| 5,642,128 | 6/1997 | Inoue | 345/96 |
| 5,648,793 | 7/1997 | Chen | 345/96 |
| 5,790,089 | 8/1998 | Ono et al. | 345/94 |
| 5,818,408 | 10/1998 | Mihara et al. | 345/94 |
| 5,841,412 | 11/1998 | Ebihara | 345/58 |
| 5,841,416 | 11/1998 | Mano et al. | 345/94 |
| 5,852,426 | 12/1998 | Erhart et al. | 345/96 |
| 5,886,680 | 3/1999 | Kanbe et al. | 345/97 |

*Primary Examiner*—Richard A. Hjerpe
*Assistant Examiner*—Henry N. Tran
*Attorney, Agent, or Firm*—Frishauf, Holtz, Goodman, Langer & Chick, P.C.

[57] ABSTRACT

Two kinds of alternation signals, that is, an alternation signal for odd-numbered electrodes and an alternation signal for even-numbered electrodes, are input to an SEG driver. In accordance with those signals, the SEG driver reverses, at different timings, the polarity of SEG drive signals which are output to odd-numbered signal electrodes and the polarity of SEG drive signals which are output to even-numbered signal electrodes. As a result, spikes are generated before and after the timing of a polarity reversal of an alternation control signal which is input to a COM driver. Further, the SEG driver reverses, at the same timing and in different directions, the polarity of the SEG drive signals which are output to the odd-numbered signal electrodes and the polarity of the SEG drive signals which are output to the even-numbered signal electrodes. By so doing, the crosstalk due to the spikes is reduced.

12 Claims, 26 Drawing Sheets

LIQUID CRYSTAL DISPLAY APPARATUS AND METHOD FOR DRIVING THE SAME

BACKGROUND OF THE INVENTION

1. Field of the Invention

The present invention relates to a liquid crystal display apparatus comprising a liquid crystal driving mechanism to prevent crosstalk and a method for driving the apparatus.

2. Description of the Related Art

Known as a conventional liquid crystal driving method is, for example, a voltage averaging drive method for driving a simple matrix type liquid crystal display element on a time-divisional basis. In the voltage averaging drive method, when the drive voltages for driving the pixels to be lit up are represented as V and when the voltages applied to the other pixels which are not to be lit up are represented as V/a, the value of V/a is set lower than that of V due to order to improve the visibility of display performed by a liquid crystal display panel.

However, such a conventional voltage averaging drive method has a drawback in the occurrence of the crosstalk which causes the degradation of the quality of an image. In general, when driving a liquid crystal display apparatus, the polarity of a voltage applied to the liquid crystal is reversed from positive to negative and vise versa. In accordance with a reversal of the polarity of SEG (segment) drive signals supplied to signal electrodes, differential waveforms (hereinafter referred to as spikes) occur in COM (common) drive signals supplied to scanning electrodes. Those spikes cause the crosstalk.

SUMMARY OF THE INVENTION

It is accordingly one object of the present invention to provide a liquid crystal display apparatus in which the crosstalk due to the spikes is reduced and which displays an image having an improved quality.

In order to achieve the above object, a liquid crystal display apparatus according to one aspect of the present invention comprises:

a plurality of signal electrodes;

a plurality of scanning electrodes crossing over the signal electrodes;

pixel portions each being comprised of a part of one of the signal electrodes, a part of one of the scanning electrodes and a liquid crystal, the above part of one of the signal electrodes and the above part of one of the scanning electrodes facing each other with the liquid crystal therebetween;

scanning electrode drive means for sequentially selecting the scanning electrodes by sequentially outputting scanning electrode drive signals in one to one correspondence to the scanning electrodes, each of the scanning electrode drive signals having a selection period set therein and during which a corresponding one of the scanning electrodes is selected, and polarities of voltages of the scanning electrode drive signals during the selection periods set in the scanning electrode drive signals reversing each time a predetermined period of time passes; and signal electrode drive means for outputting signal electrode drive signals to the signal electrodes, polarities of voltages of the signal electrode drive signals reversing alternately, and signal electrode drive signals which are output to at least a pair of adjacent signal electrodes of the signal electrodes being different from each other in a timing of a polarity reversal, or being the same as each other in the timing of a polarity reversal and being different from each other in the direction of a polarity reversal.

In the liquid crystal display apparatus having the above-described structure, since the spikes occurring upon a reversal of the polarities of the signal electrode drive signals which are output to adjacent signal electrodes are separated from each other or cancel out each other, the crosstalk due to the spikes is reduced, ensuring the display of an image having an improved quality.

In the above-described liquid crystal display apparatus, two kinds of alternation signals which differ from each other in the timing of a polarity reversal, or which are the same as each other in the timing of a polarity reversal and differ from each other in the direction of a polarity reversal, may be input to the signal electrode drive means. In this case, it is preferred that the two alternation signals be pulse signals having control pulses before and after a timing of a reversal of the polarities which the voltages of the scanning electrode drive signals have during the selection periods, the control pulses being 180° out of phase and having the same width.

Moreover, it is preferred that the scanning electrode drive means sequentially output, to the scanning electrodes, scanning electrode drive signals each having a selection period of a predetermined length, and that a non-selection period, which is two times as long as the width of the control pulses and during which no scanning electrode is selected, be set between the selection period of each of the scanning electrode drive signals and the selection period of the scanning electrode drive signal which is output to a scanning electrode to be selected next. With this structure, a variation which occurs in the effective value of a voltage applied to the liquid crystal during a selection period, due to the timing of a polarity reversal of the signal electrode drive signals being different from the timing of a polarity reversal of the scanning electrode drive signals, is adjusted.

Furthermore, in the above-described liquid crystal display apparatus, signal electrode drive means may include a pair of signal electrode drivers between which the signal electrodes extend, and the signal electrodes may be prolonged in opposite directions alternately and connected each to a corresponding one of the pair of signal electrode drivers. In this case, two kinds of alternation signals which differ from each other in the timing of a polarity reversal, or which are the same as each other in the timing of a polarity reversal and differ from each other in the direction of a polarity reversal, may be input to the pair of signal electrode drivers. Since the signal electrodes are prolonged in opposite directions alternately, a large pitch can be attained between the connection terminals. This is advantageous when mounting the signal electrode drivers on a chip. Further, there is an advantage in that inexpensive drivers, to each of which a single kind of alternation signal is supplied, can be used.

Furthermore, in order to achieve the aforementioned object, a liquid crystal display apparatus according to another aspect of the present invention comprises:

first signal electrodes and second signal electrodes being alternate with the first signal electrodes, the first and second signal electrodes having connection terminals formed by prolonging end portions of the first and second signal electrodes in opposite directions alternately;

scanning electrodes crossing over the first and second signal electrodes;

pixel portions each comprised of a part of one of the signal electrodes, a part of one of the scanning electrodes and a liquid crystal, the above part of one of the signal electrodes and the above part of one of the scanning electrodes facing each other with the liquid crystal therebetween;

scanning electrode drive means for sequentially selecting the scanning electrodes by sequentially outputting scanning electrode drive signals in one to one correspondence to the scanning electrodes, each of the scanning electrode drive signals having a selection period set therein and during which a corresponding one of the scanning electrodes is selected, and polarities of voltages of the scanning electrode drive signals during the selection periods set in the scanning electrode drive signals reversing each time a predetermined period of time passes; and a pair of signal electrode drive means for outputting signal electrode drive signals to the signal electrodes, the first and second signal electrodes extending between the pair of signal electrode drive means, the prolonged end portions of the first signal electrodes being connected to one of the pair of signal electrode drive means, the prolonged end portions of the second signal electrodes being connected to the other of the pair of signal electrode drive means, signal electrode drive signals which are output to at least a pair of adjacent signal electrodes of the first signal electrodes being different from each other in a timing of a polarity reversal, or being the same as each other in the timing of a polarity reversal and differing from each other in a direction of a polarity reversal, and signal electrode drive signals which are output to at least a pair of adjacent signal electrodes of the second signal electrodes being different from each other in the timing of a polarity reversal, or being the same as each other in the timing of a polarity reversal and differing from each other in the direction of a polarity reversal.

In the liquid crystal display apparatus having the above-described structure, a large pitch can be attained between the connection terminals of the signal electrodes, and the spikes occurring upon a reversal of the polarities of the signal electrode drive signals output to at least a pair of signal electrodes, which are adjacent to each other with another signal electrode being located therebetween, are separated from each other or assuredly cancel out each other. This results in a reduction in the crosstalk due to the spikes, and ensures the display of an image having a further improved quality.

In the above liquid crystal display apparatus, two kinds of alternation signals, which differ from each other in a timing of a polarity reversal, or which are the same as each other in the timing of a polarity reversal and differ from each other in the direction of a polarity reversal, may be input to each of the pair of signal electrode drive means. In that case, it is preferred that the two alternation signals be pulse signals having control pulses before and after a timing of a reversal of the polarities which the potentials of the scanning electrode drive signals have during the selection periods, the control pulses being 180° out of phase and having the same width. Furthermore, it is preferred that the scanning electrode drive means sequentially output, to the scanning electrodes, scanning electrode drive signals each having a selection period of a predetermined length, and that a non-selection period, which is two times as long as the width of the control pulses and during which no scanning electrode is selected, be set between the selection period of each of the scanning electrode drive signals and the selection period of the scanning electrode drive signal which is output to a scanning electrode to be selected next. With this structure, a variation which occurs in the effective value of a voltage applied to the liquid crystal during a selection period, due to the timing of a polarity reversal of the signal electrode drive signals being different from the timing of a polarity reversal of the scanning electrode drive signals, is adjusted.

In order to achieve the aforementioned object, a liquid crystal display apparatus according to another aspect of the present invention comprises:

a liquid crystal panel which includes signal lines, scanning lines crossing over the signal lines, and pixel portions arranged in a matrix pattern at crossings of the signal and scanning lines, each of the pixel portions being comprised of a liquid crystal and a pair of electrodes facing each other with the liquid crystal therebetween;

scanning electrode drive means for sequentially selecting the scanning lines by outputting scanning electrode drive signals in one to one correspondence to the scanning lines, each of the scanning electrode drive signals having a selection period set therein and during which a corresponding one of the scanning electrodes is selected, and polarities of voltages of the scanning electrode drive signals during the selection periods set in the scanning electrode drive signals reversing in each time a predetermined period of time passes; and signal electrode drive means for outputting signal electrode drive signals to the signal lines, polarities of voltages of the signal electrode drive signals reversing alternately, and signal electrode drive signals which are output to at least a pair of signal electrodes of the signal electrodes being different in a timing of a polarity reversal, or being the same as each other in the timing of a polarity reversal and differing from each other in a direction of a polarity reversal.

It is another object of the present invention to provide a drive method for driving a liquid crystal display apparatus in which the crosstalk due to the spikes is reduced and which displays an image having an improved quality.

According to the present invention, in order to achieve this object, a drive method for driving a liquid crystal display apparatus comprises steps of:

preparing a liquid crystal display element which comprises signal electrodes, scanning electrodes crossing over the signal electrodes, and pixel portions, each of which is comprised of a part of one of the signal electrodes, a part of one of the scanning electrodes and a liquid crystal, the above part of one of the signal electrodes and the above part of one of the scanning electrodes facing each other with the liquid crystal therebetween;

sequentially selecting the scanning electrodes by sequentially outputting scanning electrode drive signals in one to one correspondence to the scanning electrodes, each of the scanning electrode drive signals having a selection period set therein and during which a corresponding one of the scanning electrodes is selected, and polarities of voltages of the scanning electrode drive signals during the selection periods set in the scanning electrode drive signals reversing each time a predetermined period of time passes; and outputting two signal electrode drive signals to at least a pair of signal electrodes of the signal electrodes, respectively, the two signal electrode drive signals being different from each other in a timing of a polarity reversal, or being the same as each other in the timing of a polarity reversal and differing from each other in a direction of a polarity reversal.

With the above-described method, the spikes occurring upon a reversal of the polarities of the signal electrode drive signals output to the signal electrodes are separated from each other or cancel out each other. This results in a reduction in the crosstalk due to the spikes, and ensures the display of an image having an improved quality.

In the above-described drive method, the aforementioned two signal electrode drive signals may be output respectively to a pair of adjacent signal electrodes, or may be output respectively to signal electrodes which are adjacent to each other with another signal electrode being located therebetween.

Furthermore, in the above drive method, the aforementioned two signal electrode drive signals may be generated in accordance with two kinds of alternation signals, the alternation signals being different from each other in a timing of a polarity reversal, or being the same as each other in the timing of a polarity reversal and differing from each other in a direction of a polarity reversal. In that case, it is preferred that the aforementioned two kinds of alternation signals be pulse signals having control pulses before and after a timing of a reversal of the polarities which the voltages of the scanning electrode drive signals have during the selection periods, the control pulses being 180° out of phase and having the same width. Furthermore, it is preferred that each of the scanning electrode drive signals have a selection period of a predetermined length, and that the scanning electrode drive signals be output sequentially to the scanning electrodes, and that a non-selection period, which is two times as long as the width of the control pulses and during which no scanning electrode is selected, be set between the selection period of each of the scanning electrode drive signals and the selection period of the scanning electrode drive signal which is output to a scanning electrode to be selected next. With this structure, a variation which occurs in the effective value of a voltage applied to the liquid crystal during a selection period, due to the timing of a polarity reversal of the signal electrode drive signals being different from the timing of a polarity reversal of the scanning electrode drive signals, is adjusted.

DETAILED DESCRIPTION OF THE PREFERRED EMBODIMENTS

Embodiments of the present invention will now be described in detail, with reference to the drawings.

First Embodiment

FIGS. 1A to 14 show a liquid crystal display apparatus according to the first embodiment of the present invention.

First of all, the structure of the apparatus will be explained.

Figure 1A:
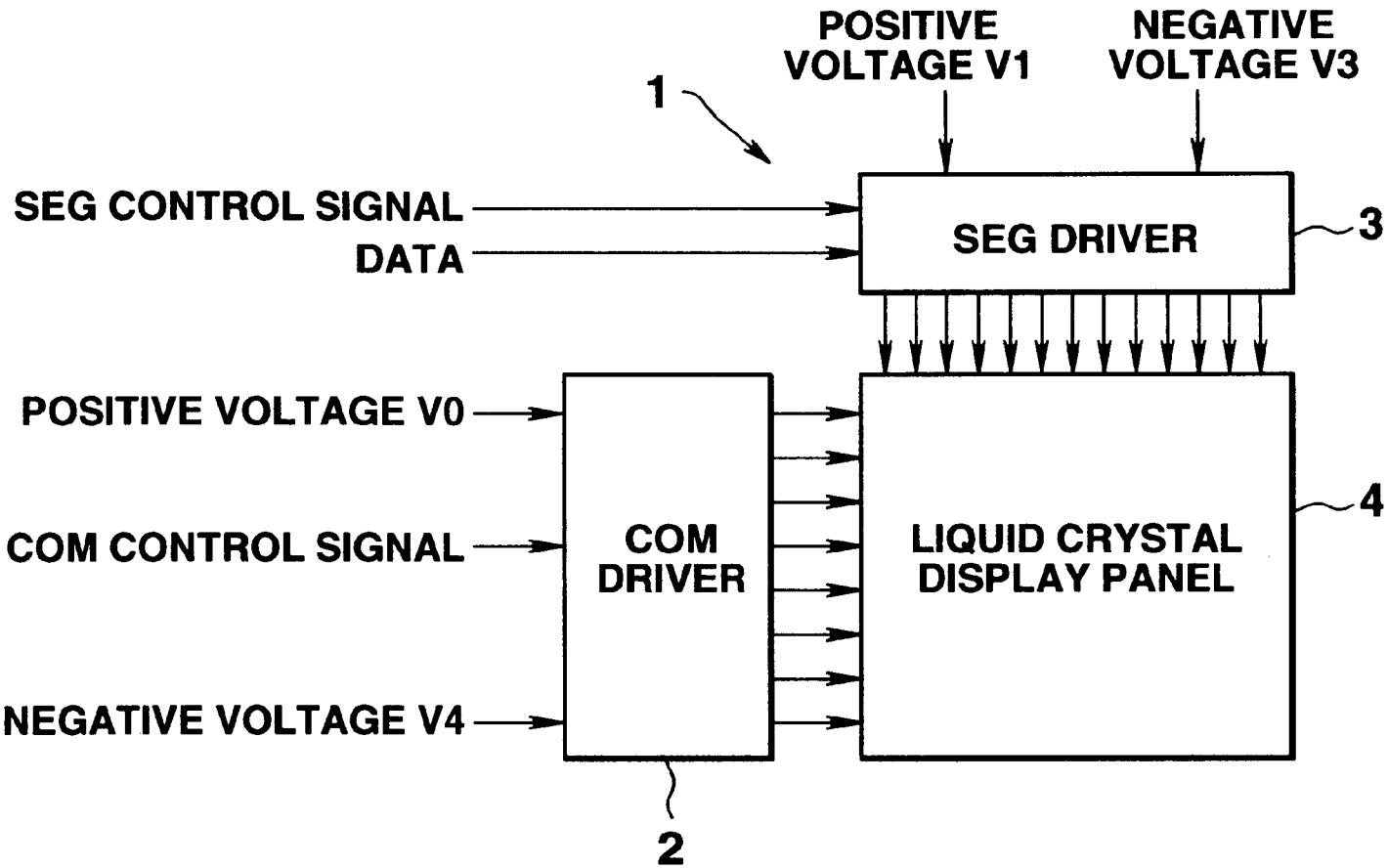
FIG. 1A is a block diagram showing the structure of the main part of a liquid crystal display apparatus 1 according to the first embodiment of the present invention.

FIG. 1A is a block diagram showing the structure of the main part of the liquid crystal display apparatus 1 according to the first embodiment of the present invention. In FIG. 1A, the liquid crystal display apparatus 1 includes a COM driver 2 for driving scanning electrodes, an SEG driver 3 for driving signal electrodes, and a liquid crystal display panel 4. The liquid crystal display panel 4 has a 10×10-dot size.

Figure 1B:
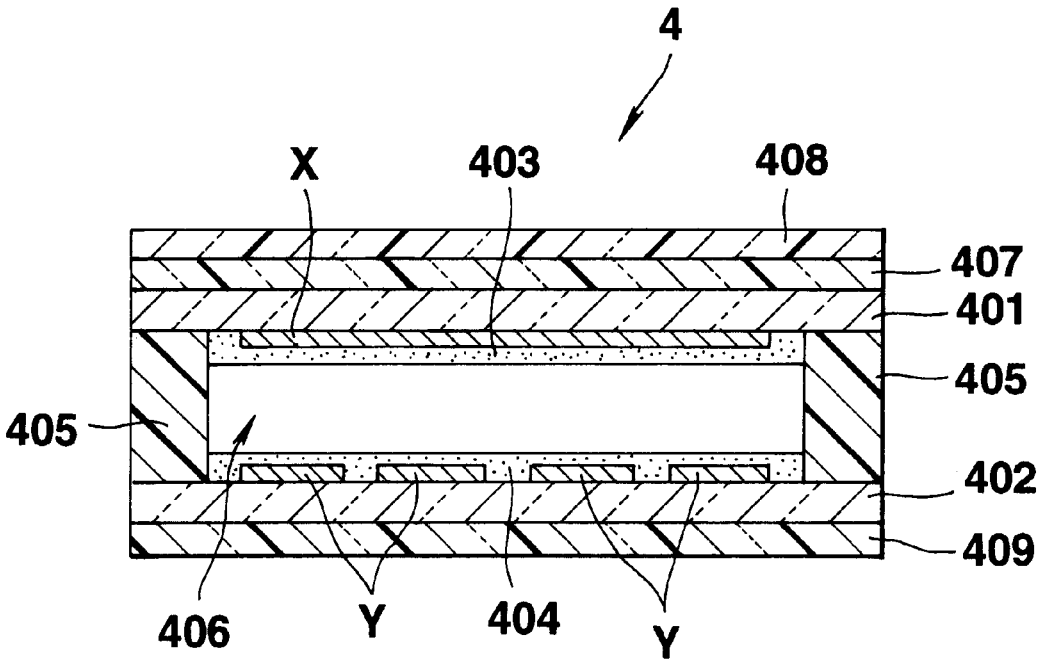
FIG. 1B is a diagram showing a cross-sectional view of a liquid crystal display panel 4 illustrated in FIG. 1A.

In FIG. 1B, the liquid crystal display panel 4 is an STN type liquid crystal display panel in which the liquid crystal molecules are twisted at angles ranging from 180° to 270°. In this liquid crystal display panel, an upper glass substrate 401 and a lower glass substrate 402 are arranged facing each other with a predetermined minute gap (several micrometers) therebetween, and a liquid crystal is sealed in the gap. Scanning electrodes X and signal electrodes Y, which are made of a transparent conductive material such as ITO (Indium Tin Oxide), are arranged on the opposed surfaces of the glass substrates 401 and 402. The electrodes X are located on the glass substrate 401, the electrodes Y are located on the substrate 402, and the electrodes X cross over the electrodes Y with a liquid crystal layer being sandwiched between the substrates 401 and 402. Those parts of the electrodes X and Y which face each other define pixel portions which are arranged in a matrix pattern in the display apparatus.

An alignment film 403 is laminated on the scanning electrodes X, while another alignment film 404 is laminated on the signal electrodes Y. The alignment films 403 and 404 are those for controlling the direction of the alignment of the liquid crystal molecules.

A sealing member 405 is arranged between the peripheral parts of the upper and lower glass substrates 401 and 402. The sealing member 405 keeps the glass substrates 401 and 402 separated from each other by a predetermined interval, and seals the liquid crystal in the gap between the glass substrates 401 and 402.

In the liquid crystal layer 406, the liquid crystal molecules are twisted from one glass substrate toward the other, for example, from the glass substrate 401 to the glass substrate 402 at angles ranging from 180° to 270°.

A retardation plate 407 compensates the birefringence effect to which light is subjected when passing through the liquid crystal layer 406.

Each of an upper polarizer 408 and a lower polarizer 409 has a transmission axis and an absorption axis. The polarizers 408 and 409 absorb the polarized light components entering them along their absorption axes, but allow the polarized light components entering them along their transmission axes to be transmitted therethrough.

Figure 2:
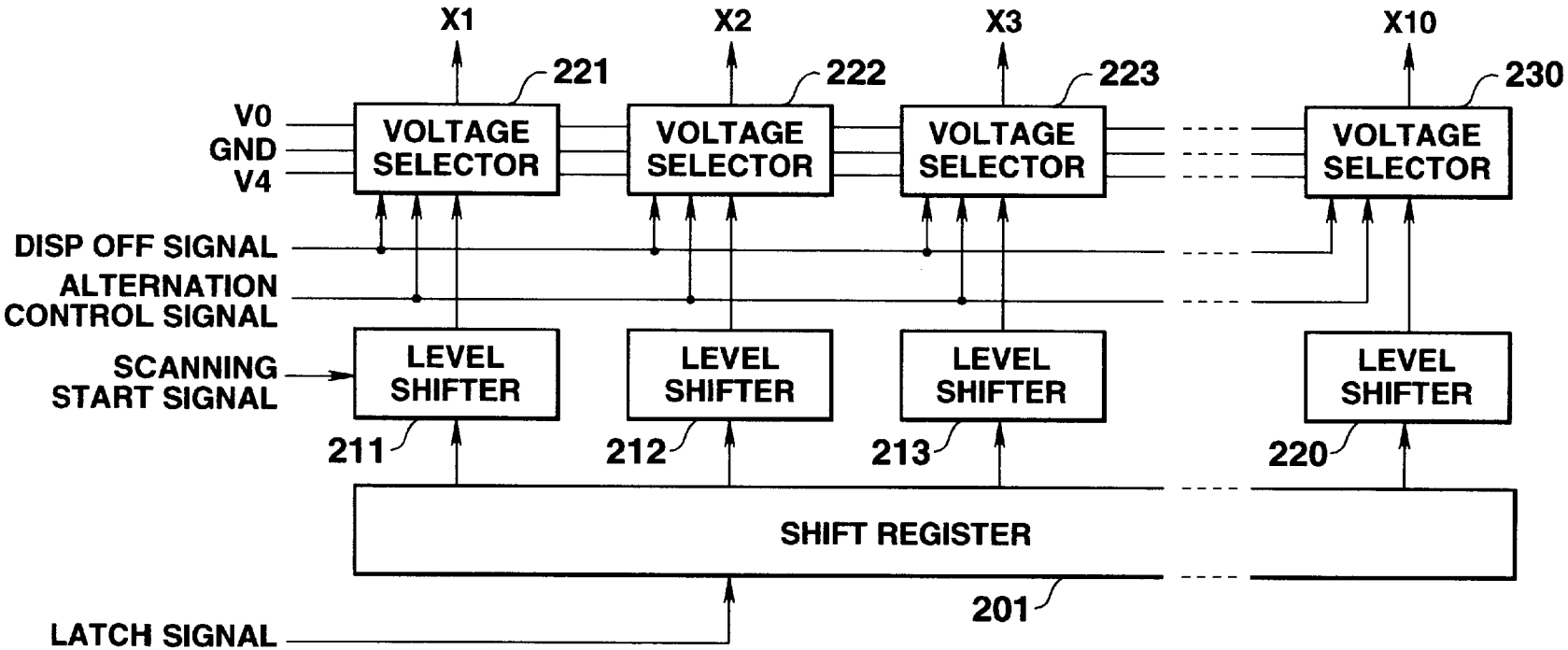
FIG. 2 is a diagram showing the structure of the internal circuitry of a COM driver 2 illustrated in FIG. 1A.

As shown in FIG. 2, a COM driver 2 includes a shift register 201, level shifters 211 to 220 and voltage selectors 221 to 230. A liquid crystal drive power source (not shown) applies a positive drive voltage V0 and a negative drive voltage V4 as drive power source voltages to the COM driver 2. A controller (not shown) inputs COM control signals (a latch signal, a scanning start signal, an alternation control signal and a DISP OFF signal) to the COM driver 2.

The shift register 201 latches scanning start signals input from the controller, in response to the latch signal. The shift register 201 shifts the latched signals one per scanning electrode, and outputs them to the level shifters 211 to 220. The level shifters 211 to 220 convert the scanning start signals input from the shift register 201 to a liquid crystal drive voltage level, and output the resultant signals to the voltage selectors 221 to 230. The voltage selectors 221 to 230 sequentially select either the positive drive voltage V0 or the negative drive voltage V4 as a COM drive voltage in accordance with the alternation control signal input from the controller, and sequentially drive scanning electrodes X1 to X10.

Furthermore, the voltage selectors 221 to 230 change the COM drive voltage to a GND (ground) level in response to a DISP OFF signal supplied from the controller, thereby turning off the display of an image on the liquid crystal display panel 4.

Figure 3:
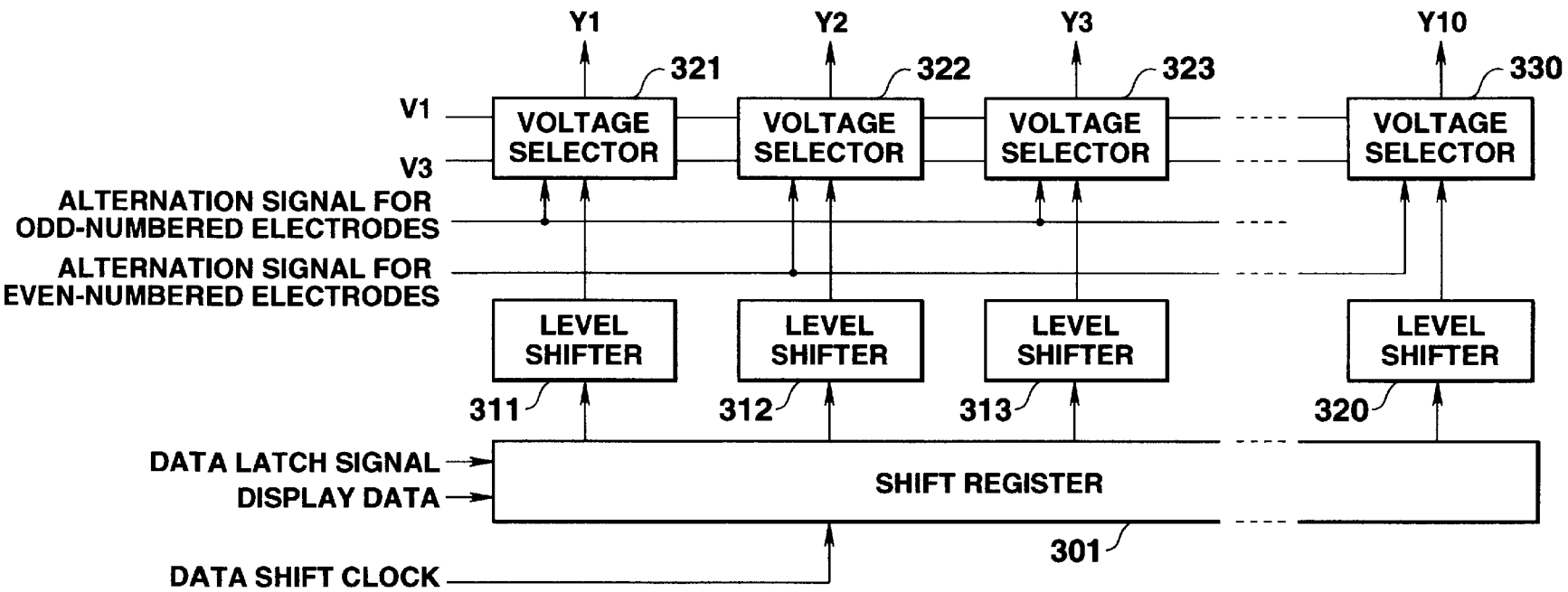
FIG. 3 is a diagram showing the structure of the internal circuitry of an SEG driver 3 illustrated in FIG. 1A.

As shown in FIG. 3, the SEG driver 3 includes a shift register 301, level shifters 311 to 320 and voltage selectors 321 to 330. The liquid crystal drive power source (not shown) applies a positive drive voltage V1 and a negative drive voltage V3 as the drive power source voltages to the SEG driver 3. The controller (not shown) inputs SEG control signals (a data shift clock, a data latch signal, an alternation signal for odd-numbered electrodes, and an alternation signal for even-numbered electrodes) and DATA (display data) to the SEG driver 3.

The display data input from the controller is fetched into the shift register 301 in synchronization with the input data shift clock. In response to the data latch signal, the shift register 301 latches the display data for all signal electrodes in time to 1 horizontal scanning period of the signal electrodes, and outputs the latched display data simultaneously to the level shifters 311 to 320. The level shifters 311 to 320 convert the display data for all signal electrodes to the liquid crystal drive voltage level, and outputs the resultant data to the voltage selectors 321 to 330. The voltage selectors 321 to 330 sequentially select either the positive drive voltage V1 or the negative drive voltage V3 in accordance with the alternation signal for the odd-numbered electrodes which has been input from the controller, and sequentially drive odd-numbered signal electrodes Y1, Y3, Y5, Y7 and Y9. In accordance with the alternation signal for the even-numbered electrodes which has been input from the controller, the voltage selectors 321 to 330 sequentially select either the positive drive voltage V1 or the negative drive voltage V3, and sequentially drive even-numbered signal electrodes Y2, Y4, Y6, Y8 and Y10.

Figure 4:
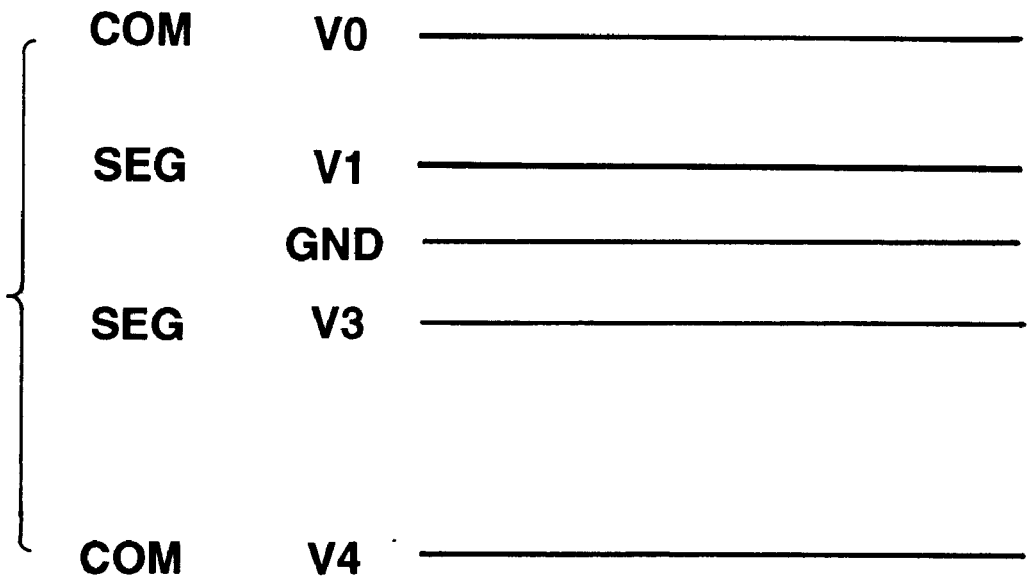
FIG. 4 is a diagram showing the relationship between liquid crystal drive voltage levels selected by the COM driver 2 and the SEG driver 3, both drivers being illustrated in FIG. 1A.

As shown in FIG. 4, the relationship between the positive drive voltage V0, the negative drive voltage V4, the positive drive voltage V1 and the negative drive voltage V3, one of the voltages V0 and V4 being selected by the COM driver 2 and one of the voltages V1 and V3 being selected by the SEG driver 3, is the same as that in a general voltage averaging drive method.

The liquid crystal display panel 4 has the ten scanning electrodes X1 to X10 and the ten signal electrodes Y1 to Y10, since the display panel 4 forms an image display area having a 10×10-dot size. The liquid crystal display panel 4 displays an image with the scanning electrodes X1 to X10 being driven by the COM driver 2 and with the signal electrodes Y1 to Y10 being driven by the SEG driver 3.

The operations according to the first embodiment will now be described.

First of all, the operation of the COM driver 2 will be described with reference to the timing charts shown in FIGS. 5 and 6.

Figure 5:
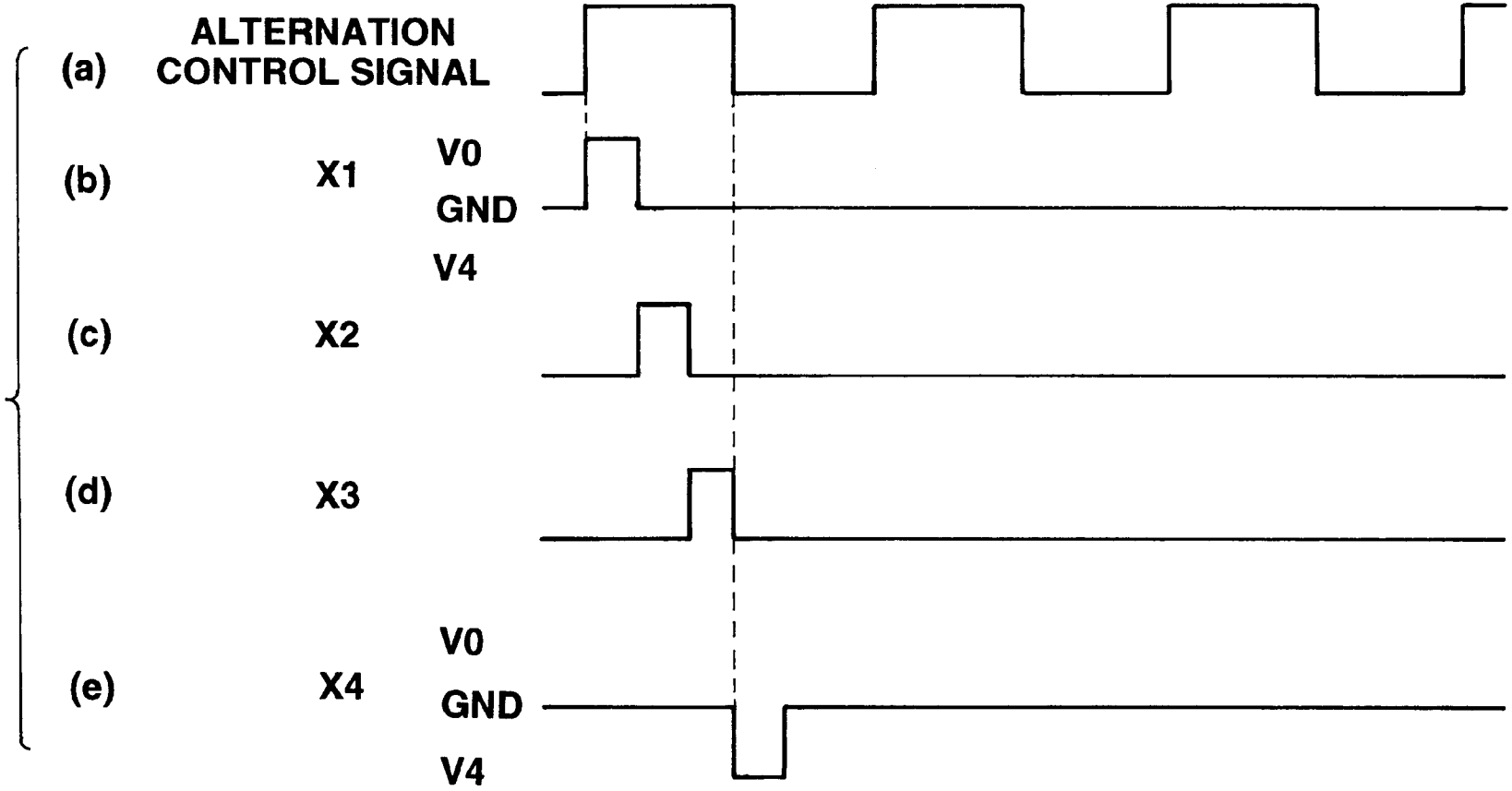
FIG. 5 is a timing chart for explaining the operation of the COM driver 2 illustrated in FIG. 1A.

In FIG. 5, (a) shows an alternation control signal, and (b) to (e) show COM drive signals for driving the scanning electrodes X1 to X4, respectively. In FIG. 6, (a) shows the alternation control signal, (b) shows a DISP OFF signal, and (c) to (f) show the COM drive signals for driving the scanning electrodes X1 to X4, respectively.

In the COM driver 2, the shift register 201 latches scanning start signals input from the controller, in response to the latch signal. The shift register 201 shifts the latched signals one for each of the scanning electrodes X1 to X4, and output them to the level shifters 211 to 220. The level shifters 211 to 220 convert the scanning start signals input from the shift register 201 to the liquid crystal drive voltage level, and output the resultant signals to the voltage selectors 221 to 230. The voltage selectors 221 to 230 sequentially select either the positive drive voltage V0 or the negative drive voltage V4 as the COM drive voltage in accordance with the alternation control signal (a) of FIG. 5 and input from the controller, and sequentially output the selected voltage. The scanning electrodes X1 to X10 are sequentially driven by an alternation signal, as shown in (b) to (e) of FIG. 5.

Figure 6:
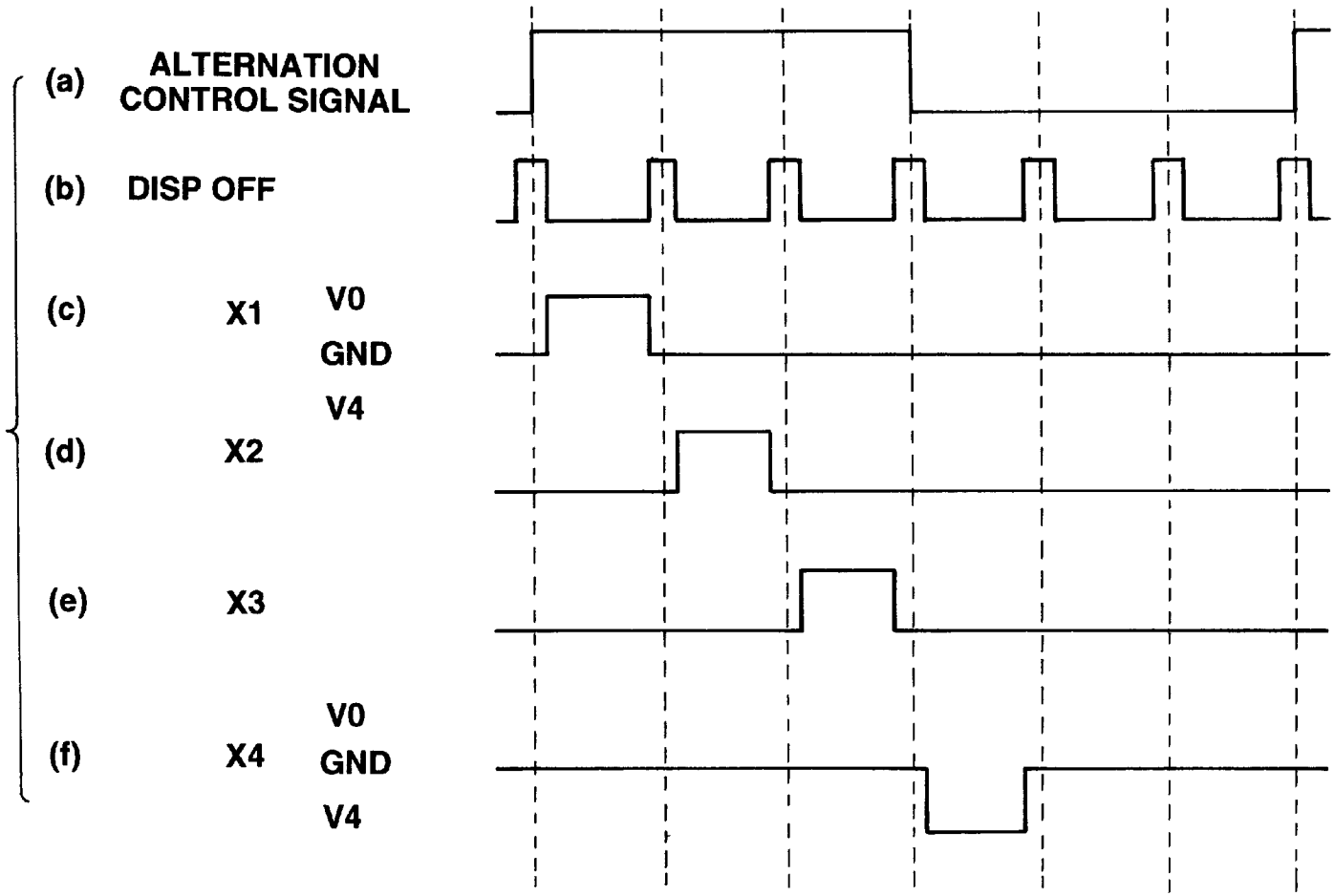
FIG. 6 is a timing chart for explaining how the COM driver 2 illustrated in FIG. 1A operates in response to a DISP OFF signal.

When the DISP OFF signal (b) of FIG. 6 is input from the controller, the COM driver 2 compulsorily sets the COM drive voltage at the GND (ground) level, thereby turning off the display of an image on the liquid crystal display panel 4.

The operation of the SEG driver 3 will now be described with reference to the timing chart shown in FIG. 7.

Figure 7:
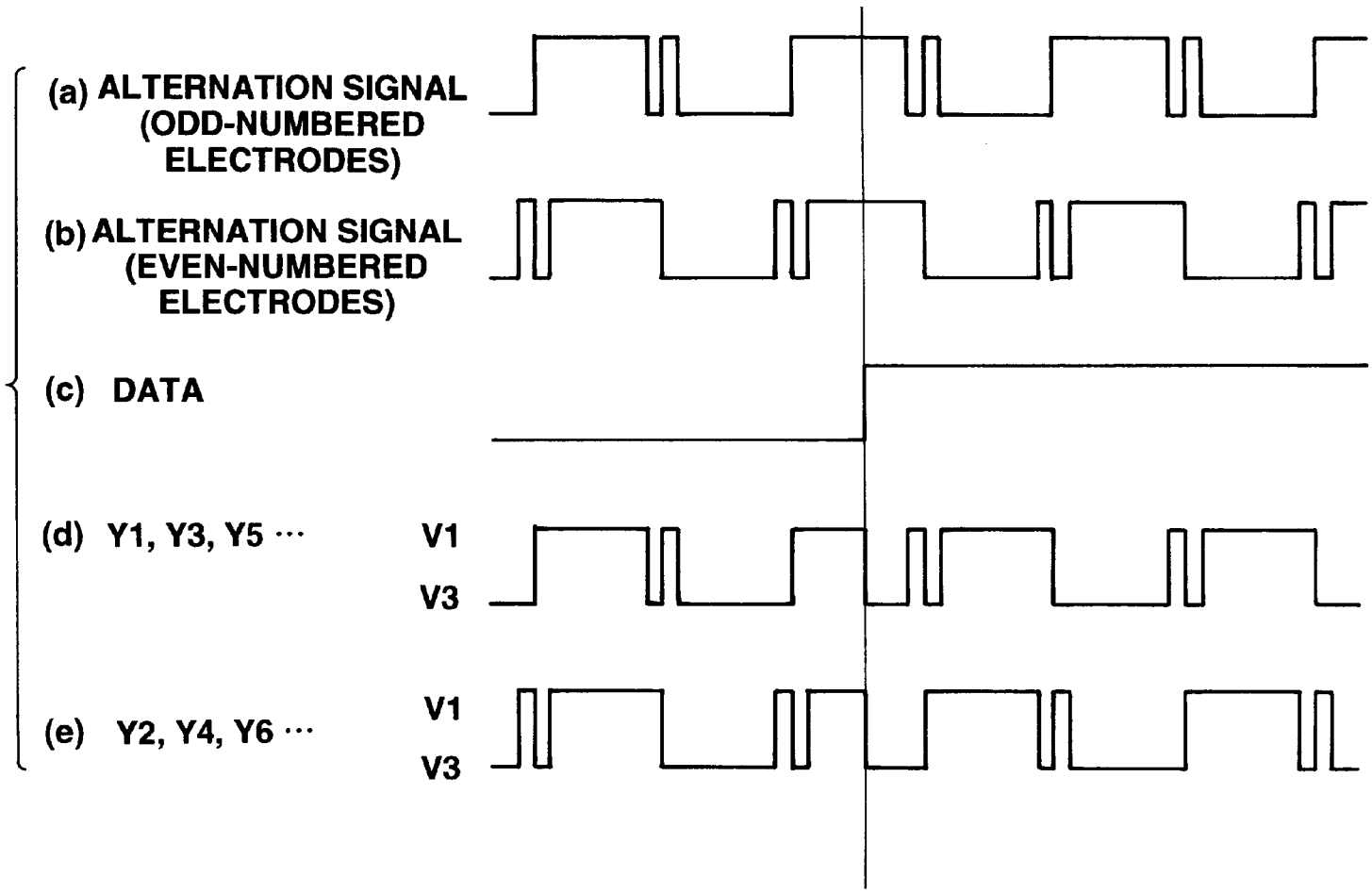
FIG. 7 is a timing chart for explaining the operation of the SEG driver 3 illustrated in FIG. 1A.

In FIG. 7, (a) shows an alternation signal for odd-numbered electrodes; (b) shows an alternation signal for even-numbered electrodes; (c) shows display data (DATA); (d) shows SEG drive signals for driving odd-numbered signal electrodes Y1, Y3, Y5, Y7 and Y9; and (e) shows SEG drive signals for driving even-numbered signal electrodes Y2, Y4, Y6, Y8 and Y10.

The display data (c) which is shown in FIG. 7 and which is input from the controller is fetched into the shift register 301 of the SEG driver 3 in synchronization with the input data shift clock. In response to the latch signal, the shift register 301 latches the display data for all signal electrodes in time to 1 horizontal scanning period of the signal electrodes, and outputs the latched display data simultaneously to the level shifters 311 to 320. The level shifters 311 to 320 convert the display data for all signal electrodes to the liquid crystal drive voltage level, and output the resultant signals to the voltage selectors 321 to 330. The voltage selectors 321 to 330 sequentially select either the positive drive voltage V1 or the negative drive voltage V3 in accordance with the alteration signal (a) which is shown in FIG. 7 as one for the odd-numbered electrodes and which is input from the controller, and the odd-numbered signal electrodes Y1, Y3, Y5, Y7 and Y9 are driven as shown in (d) of FIG. 7. In accordance with the alteration signal (b) which is shown in FIG. 7 as one for the even-numbered electrodes and which is input from the controller, the voltage selectors 321 to 330 sequentially select either the positive drive voltage V1 or the negative drive voltage V3, and the even-numbered signal electrodes Y2, Y4, Y6, Y8 and Y10 are driven as shown in (e) of FIG. 7.

As shown in FIG. 7, in order to reduce the spikes which occur when reversing the signal level of the COM drive voltage, a pulse is generated in the alternation signal (b) for the even-numbered electrodes and at the timing of the rise of the alternation signal (a) for the odd-numbered electrodes, while a pulse is generated in the alternation signal (a) at the timing of the fall of the alternation signal (b).

Figure 8:
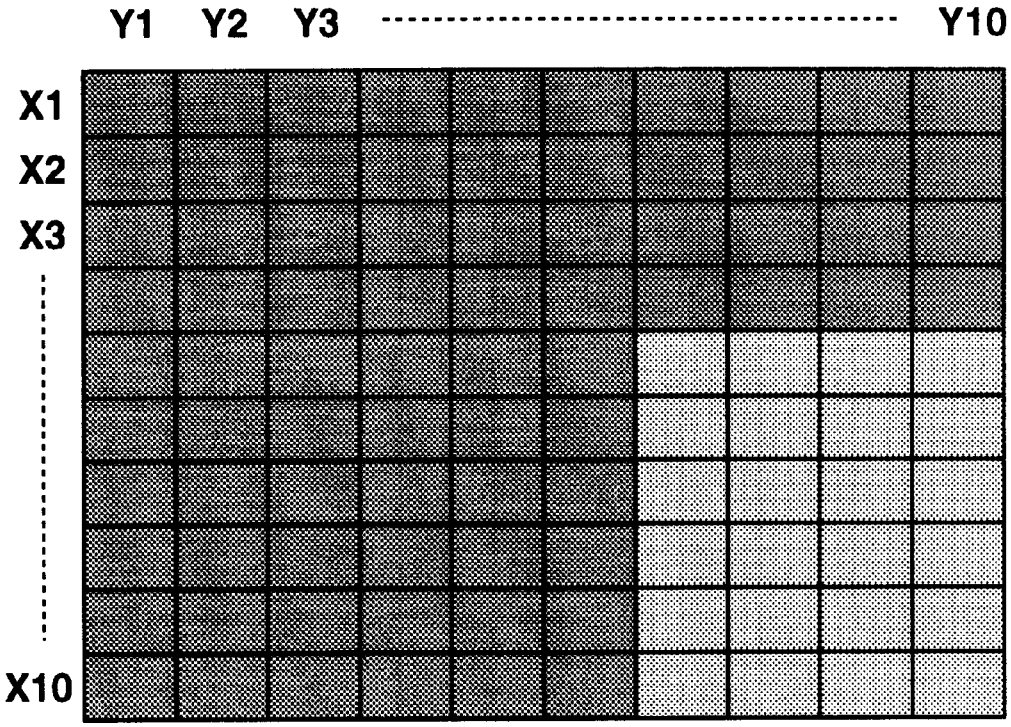
FIG. 8 is a diagram exemplifying display on the liquid crystal display panel 4 illustrated in FIG. 1A.
Figure 9:
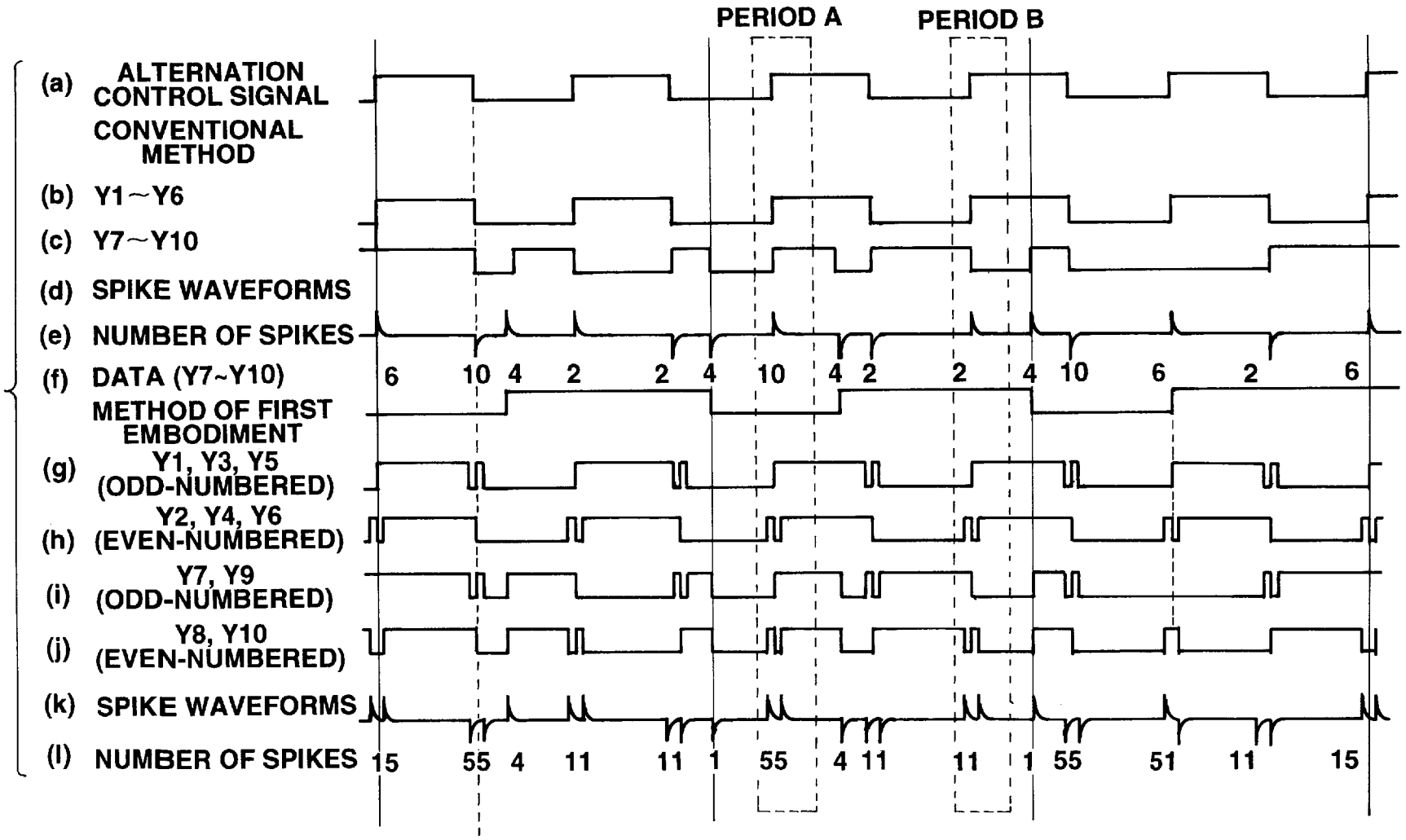
FIG. 9 is a timing chart showing drive waveforms according to a conventional voltage averaging drive method and those according to the drive method of the first embodiment of the present invention, in association with the example depicted in FIG. 8.

FIG. 8 shows an example of the display performed by the liquid crystal display panel 4. In this example, a white image is displayed on that area of the liquid crystal display panel 4 which is designated by the scanning electrodes X5 to X10 and the signal electrodes Y7 to Y10, and a black image is displayed on the remaining area. FIG. 9 shows the drive waveforms according to the conventional voltage averaging drive method and those according to the drive method of the first embodiment of the present invention, in association with the example depicted in FIG. 8.

In FIG. 9, (a) shows the alternation control signal; (b) shows SEG drive signals for driving the signal electrodes Y1 to Y6 (the area displaying the black image) according to the conventional drive method; (c) shows SEG drive signals for driving the signal electrodes Y7 to Y10 (the area displaying the white image) according to the conventional drive method; (d) shows the waveforms of the spikes caused by the SEG drive signals (b) and (c); (e) shows the number of spikes corresponding to the spike waveforms (c); (f) shows the display data (Y7 to Y10); (g) shows SEG drive signals for driving the odd-numbered signal electrodes Y1, Y3 and Y5 (the area displaying the black image) according to the drive method of the first embodiment of the present invention; (h) shows SEG drive signals for driving the even-numbered signal electrodes Y2, Y4 and Y6 (the area displaying the white image); (i) shows SEG drive signals for driving the odd-numbered signal electrodes Y7 and Y9 (the area displaying the white image) according to the drive method of the first embodiment; (j) shows SEG drive signals for driving the odd-numbered signal electrodes Y8 and Y10 (the area displaying the white image) according to the method of the first embodiment; (k) shows the waveforms of the spikes caused by the SEG drive signals (g) to (j); and (l) shows the number of spikes corresponding to the spike waveforms (k).

A polarity reversal of the COM drive signals is performed every three scanning electrodes in accordance with the alternation control signal (a) shown in FIG. 9. According to the spike waveforms when employing the alternation control signal (a) and SEG drive signals (b) and (c) of FIG. 9 in the conventional method, the number of spikes is proportional to the number of SEG drive signals whose levels are changed in accordance with the alternation control signal, as seen from (e) shown in FIG. 9. In a non-selection period, the voltage applied to the liquid crystal corresponds to the difference between the magnitude of the spikes and that of the SEG drive signals.

Figure 10:
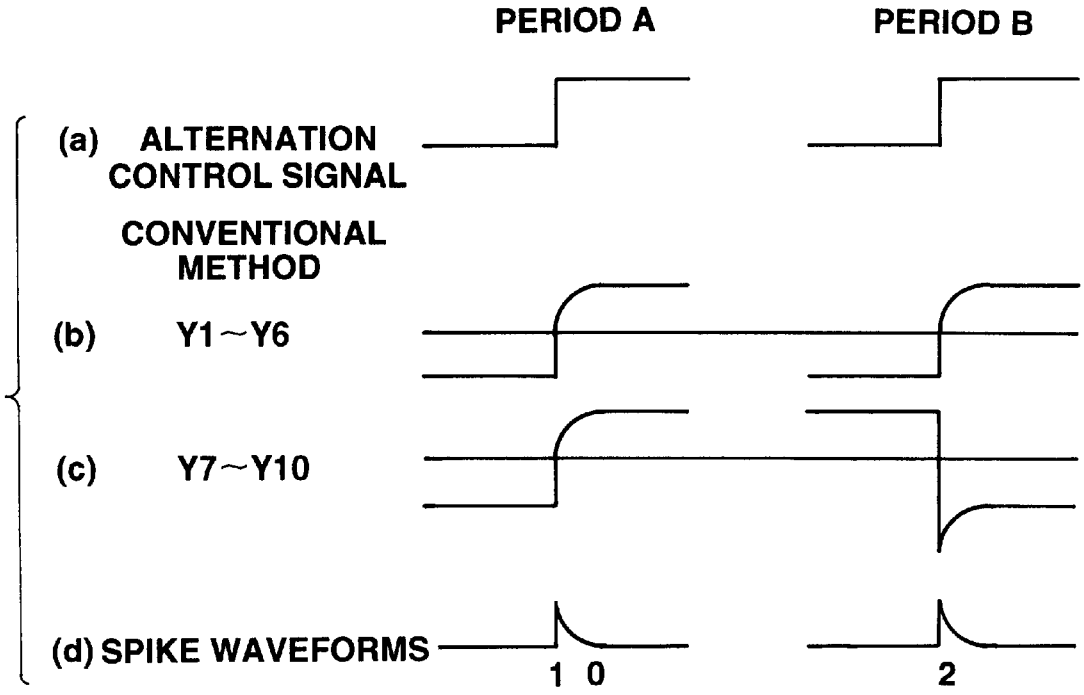
FIG.10 (PRIOR ART)
FIG. 10 is a diagram showing enlarged views of the drive waveforms according to the conventional voltage averaging drive method during periods A and B shown in FIG. 9.

The drive waveforms according to the conventional voltage averaging drive method and the drive method of the first embodiment of the present invention will now be described with reference to FIG. 10 which illustrates enlarged views of the drive waveforms according to the conventional drive method during periods A and B shown in FIG. 9, and FIG. 11 which illustrates enlarged views of the drive waveforms according to the drive method of the first embodiment during the periods A and B.

In the period A, all SEG drive signals drive their corresponding signal electrodes so that a black image is displayed. According to the conventional drive averaging drive method shown in FIG. 10, the level of the SEG drive signals (b) for driving the signal electrodes Y1 to Y6 and the level of the SEG drive signals (c) for driving the signal electrodes Y7 to Y10 change at the timing of the rise of the alternation control signal (a). Accordingly, the number of spikes is "10" (the number of signal electrodes).

Figure 11:
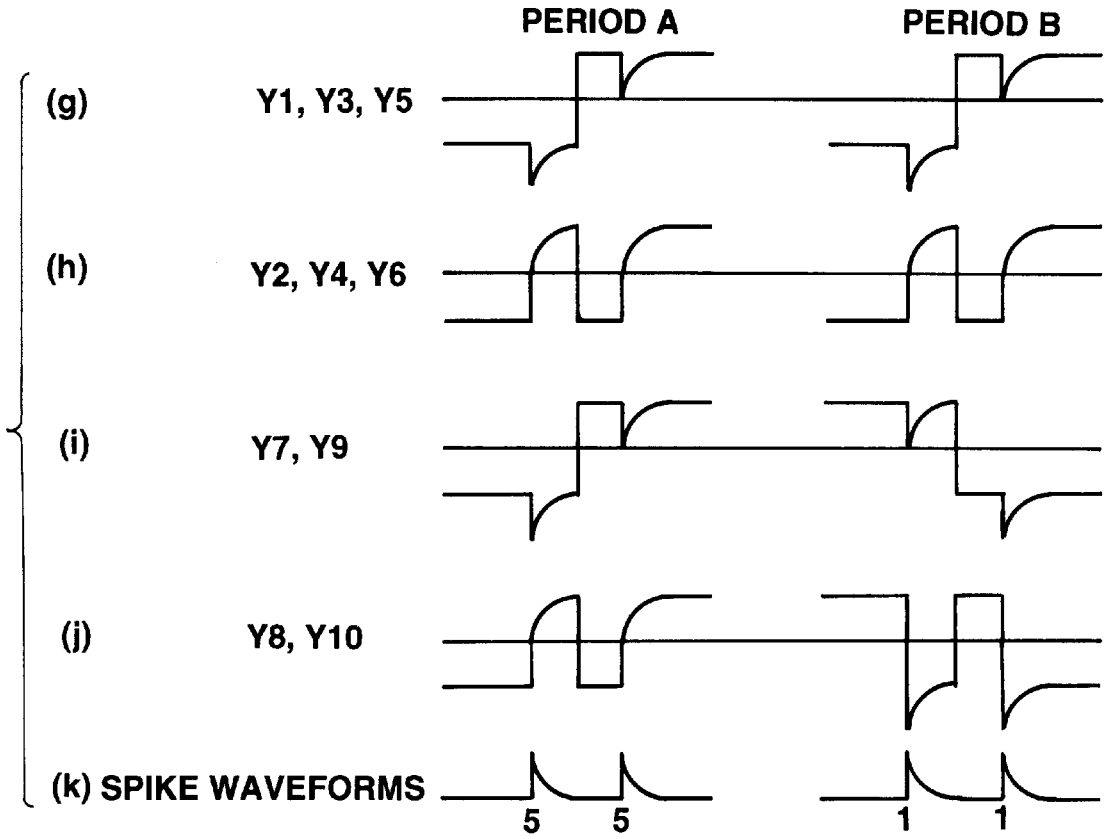
FIG. 11 is a diagram showing enlarged views of the drive waveforms according to the drive method of the first embodiment of the present invention during the periods A and B shown in FIG. 9.

In contrast, according to the drive waveforms in the drive method of the first embodiment of the present invention during the period A shown in FIG. 11, before the level of the alternation control signal changes, five spikes (the first five spikes shown in (k) of FIG. 11) the number of which is equal to the number of even-numbered signal electrodes Y2, Y4, Y6, Y8 and Y10 occur due to the waveforms of the pulses set in the SEG drive signals (h) and (j) for driving those even-numbered signal electrodes. Similarly after the level of the alternation control signal has changed, the next five spikes, the number of which is equal to the number of odd-numbered signal electrodes Y1, Y3, Y5, Y7 and Y9, occur due to the waveforms of the pulses set in the SEG drive signals (g) and (i) for driving those odd-numbered signal electrodes.

Accordingly, at the timing at which the level of the alternation control signal changes, a pulse set in one signal electrode of each adjacent pair of odd-numbered and even-numbered signal electrodes rises, and a pulse set in the other signal electrode thereof falls. In short, both pulses differ in the direction of a polarity reversal, and consequently the spikes occurring in those pulses cancel out each other.

Thus, according to the conventional voltage averaging drive method, the voltages applied to the liquid crystal are subjected to ten spikes which occur in all of the SEG drive signals for driving the signal electrodes Y1 to Y10 at the time of a change in the level of the alternation control signal. However, according to the drive method of the first embodiment of the present invention, the five spikes caused by the SEG drive signals for driving the even-numbered signal electrodes Y2, Y4, Y6, Y8 and Y10 before the change in the level of the alternation control signal are substantially canceled out by the five spikes caused by the SEG drive signals for driving their adjacent odd-numbered signal electrodes Y1, Y3, Y5, Y7 and Y9. In other words, before the change in the level of the alternation control signal, the voltage of one signal electrode of each adjacent pair of signal electrodes is opposite in polarity to that of the other signal electrode thereof, under which condition the voltage which the aforementioned one signal electrode applies to the liquid crystal increases, while the voltage which the aforementioned other signal applies to the liquid crystal decreases. In this case, the voltages applied to the liquid crystal are subjected only to the five spikes (the number of spikes is half of the conventional method) which occur in the SEG drive signals for driving the even-numbered signal electrodes Y2, Y4, Y6, Y8 and Y10 after the change in the level of the alternation control signal. Thus, the spikes which influence the voltages applied to the liquid crystal are reduced.

Figure 12:
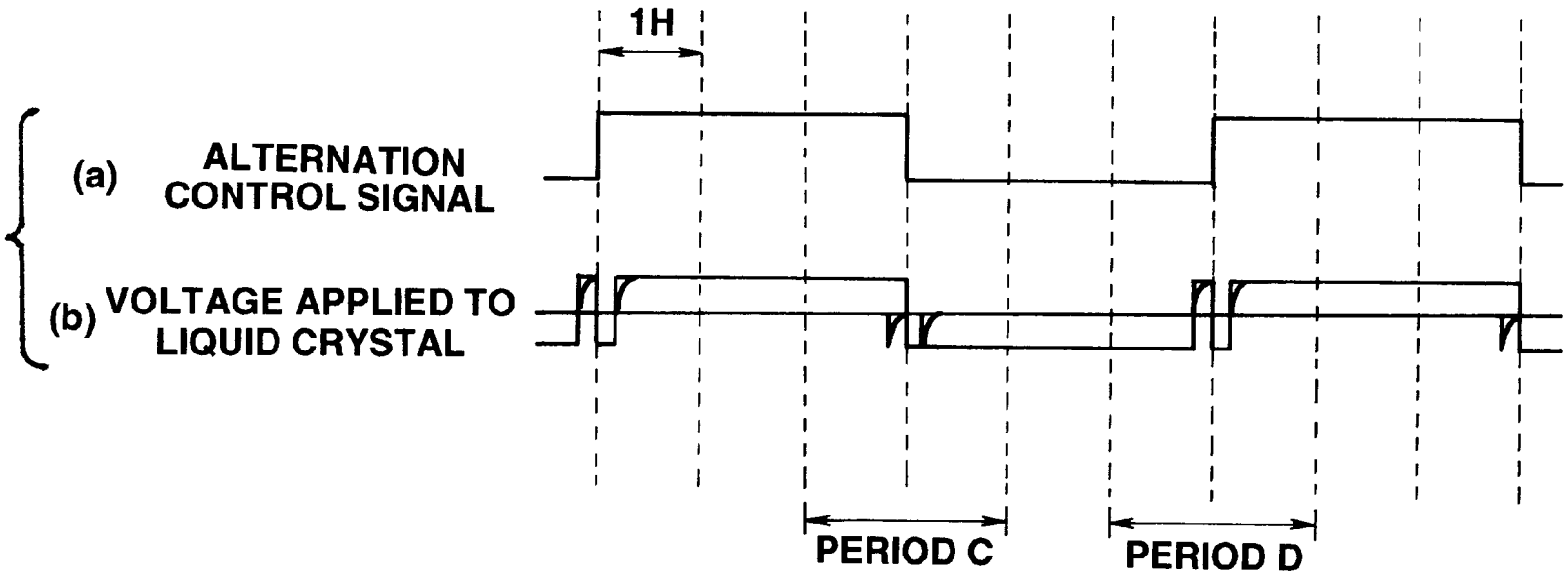
FIG. 12 is a timing chart showing how the voltage which is applied to certain pixels during a given non-selection period varies with time according to the drive method of the first embodiment of the present invention.

FIG. 12 shows how the voltage applied to a certain pixel in a given non-selection period changes with time according to the drive method of the first embodiment of the present invention. In FIG. 12, a polarity reversal of the alternation control signal (a) is performed every three scanning electrodes. In a period C shown in FIG. 12, respective influences of the spikes occurring before and after a change in the level of the alternation control signal (a) on the applied voltage (b) cancel out each other. In a period D shown in FIG. 12, on the other hand, the applied voltage (b) is influenced by the spikes occurring before and after a change in the level of the alternation control signal (a).

Figure 13:
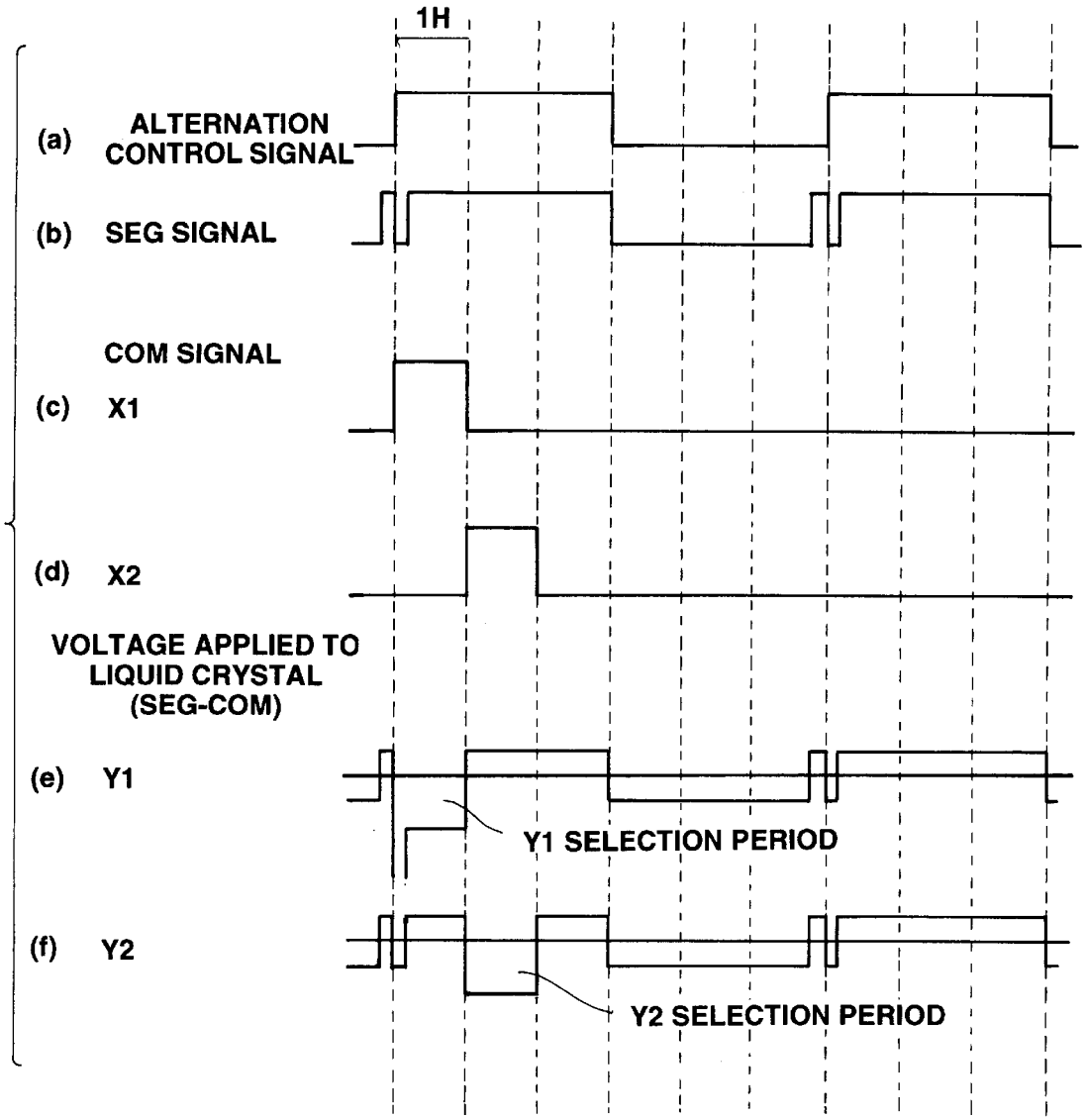
FIG. 13 is a timing chart showing how the voltage which is applied during a given selection period varies with time according to the drive method of the first embodiment of the present invention.
Figure 14:
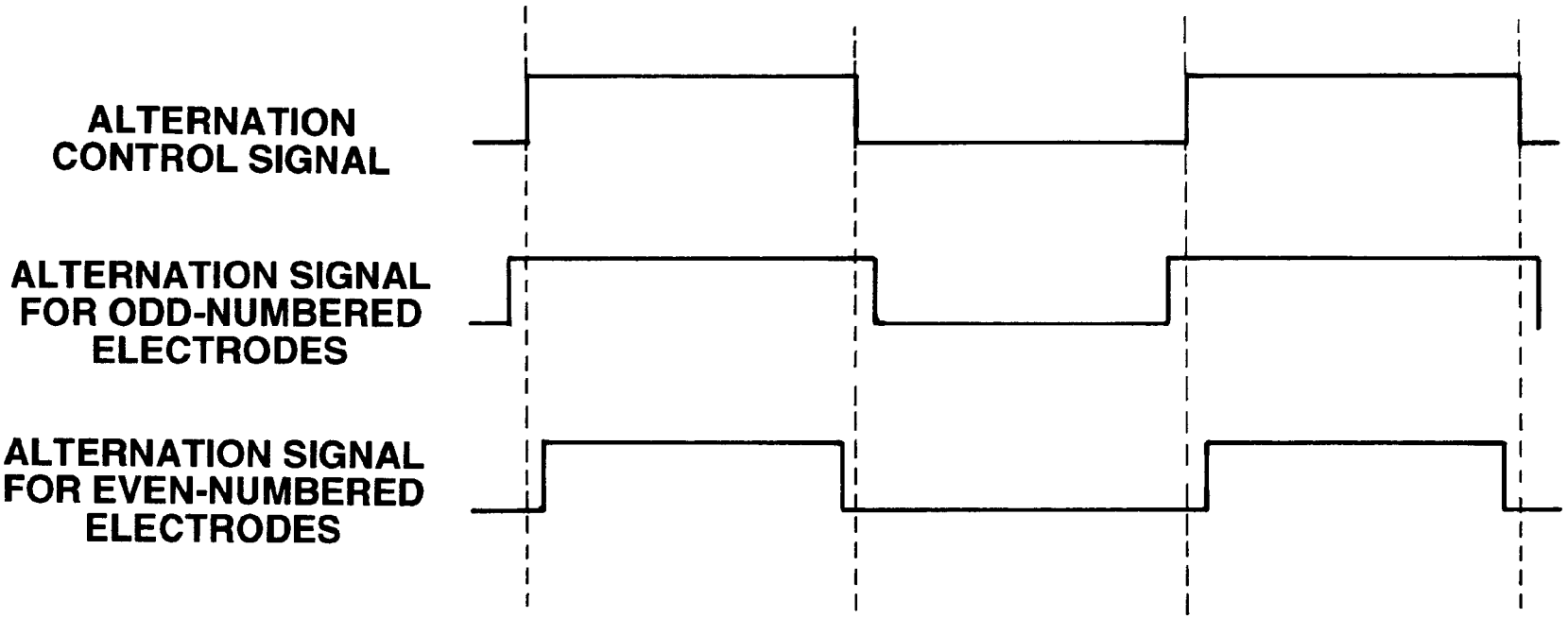
FIG. 14 is a timing chart in which an alternation signal for odd-numbered electrodes and that for even-numbered electrodes, both signals being illustrated as examples in FIG. 7, are shown as other examples.

In that case, the periods C and D alternate, under which condition a gray shades display is performed in accordance with the ratio between the area of an image displayed with the applied voltage being influenced by the spikes and the area of an image displayed without the applied voltage being influenced by the spikes. In this driving pattern, however, the effective value of the applied voltage during selection periods before and after a polarity reversal of the alternation control signal differs from that of the applied voltage when the polarity of the alternation control signal is not reversed, as can be seen from FIG. 13, for example. In FIG. 13, (a) shows an alternation control signal whose polarity is reversed every three scanning electrodes; (b) shows an SEG drive signal which is controlled so that its polarity is reversed at the timing of a polarity reversal of the alternation control signal; (c) and (d) show COM drive signals; and (e) and (f) show voltages (SEG-COM), each being a combination of the SEG drive signal (b) and the COM drive signal (c) or (d) and being applied to the liquid crystal. The effective value of the applied voltage during a Y1-selection period, which is shown in FIG. 13 and in which Y1 is selected, and the effective value of the applied voltage during a Y2-selection period, which is shown in FIG. 13 and in which Y2 is selected, differ from each other owing to the waveform of the alternation control signal, though the same display data is to be displayed in the Y1- and Y2-selection periods.

According to the first embodiment of the present invention, in consideration of the above, O-bias periods during which the bias applied to the scanning electrodes is zero are set in the COM drive signals as shown in FIG. 6, thereby preventing a difference from occurring between the effective value of the applied voltage during selection periods before and after a polarity reversal of the alternation control signal, and the effective value of the applied voltage when the polarity of the alternation control signal is not reversed.

Thus, according to the drive method of the first embodiment, not only the spikes which occur during selection periods are reduced, but also the effective value of the applied voltage during selection periods is the same as that of the applied voltage during a non-selection period. This ensures an improvement in the quality of an image which is displayed on the liquid crystal display panel 4.

Further, in the case where white display data representing a white image and black display data representing a black image having the same area as the white image are input during a scanning period in which a data signal has a high level, the spikes occurring in COM and SEG drive signals cancel out each other. Meanwhile, in the case where the white image and the black image differ in area from each other as in the example shown in FIG. 8, spikes of the number corresponding to the difference in area between the white and black images occur. Consequently, in the period B shown in FIG. 11, before and after a change in the level of the alternation control signal, voltages applied to the liquid crystal are influenced by the spikes of the number corresponding to the difference between the number of spikes occurring in the SEG signals for driving the odd-numbered signal electrodes Y1, Y3, Y5, Y7 and Y9 and the number of spikes occurring in the SEG signals for driving the even-numbered signal electrodes Y2, Y4, Y6, Y8 and Y10. In that case, the influence of the spikes is almost half of the conventional voltage averaging drive method.

As described above, the liquid crystal display apparatus 1 according to the first embodiment of the present invention employs the alternation signal for the odd-numbered signal electrodes and that for the even-numbered signal electrodes, as shown in FIG. 7, and spikes are generated before and after the levels of the alternation signals vary upon a change in the level of the alternation control signal. In the case where the DISP OFF signal is input from the controller, O-bias periods during which the bias applied to the signal electrodes is zero are set in the SEG drive signals. By so doing, a difference in the effective voltage values due to the spikes is reduced such that the crosstalk is reduced.

By thus reducing the crosstalk, the quality of an image which is displayed on the liquid crystal display apparatus 1 is improved.

In the liquid crystal display apparatus 1 of the first embodiment, signals shown in FIG. 7 are employed as the alternation signal for the odd-numbered signal electrodes and that for the even-numbered signal electrodes. However, the alternation signals are not limited thereto, and other alternation signals such as those shown in FIG. 14, for example, can also be adopted. Furthermore, explained in the first embodiment is the case where two kinds of alternation signals, one being for the odd-numbered signal electrodes and the other being for the even-numbered signal electrodes, are employed. However, three or more alternation signals can also be adopted.

Second Embodiment

FIGS. 15 to 19 are diagrams showing a liquid crystal display apparatus according to the second embodiment of the present invention.

The structure of the apparatus will be described at first.

Figure 15:
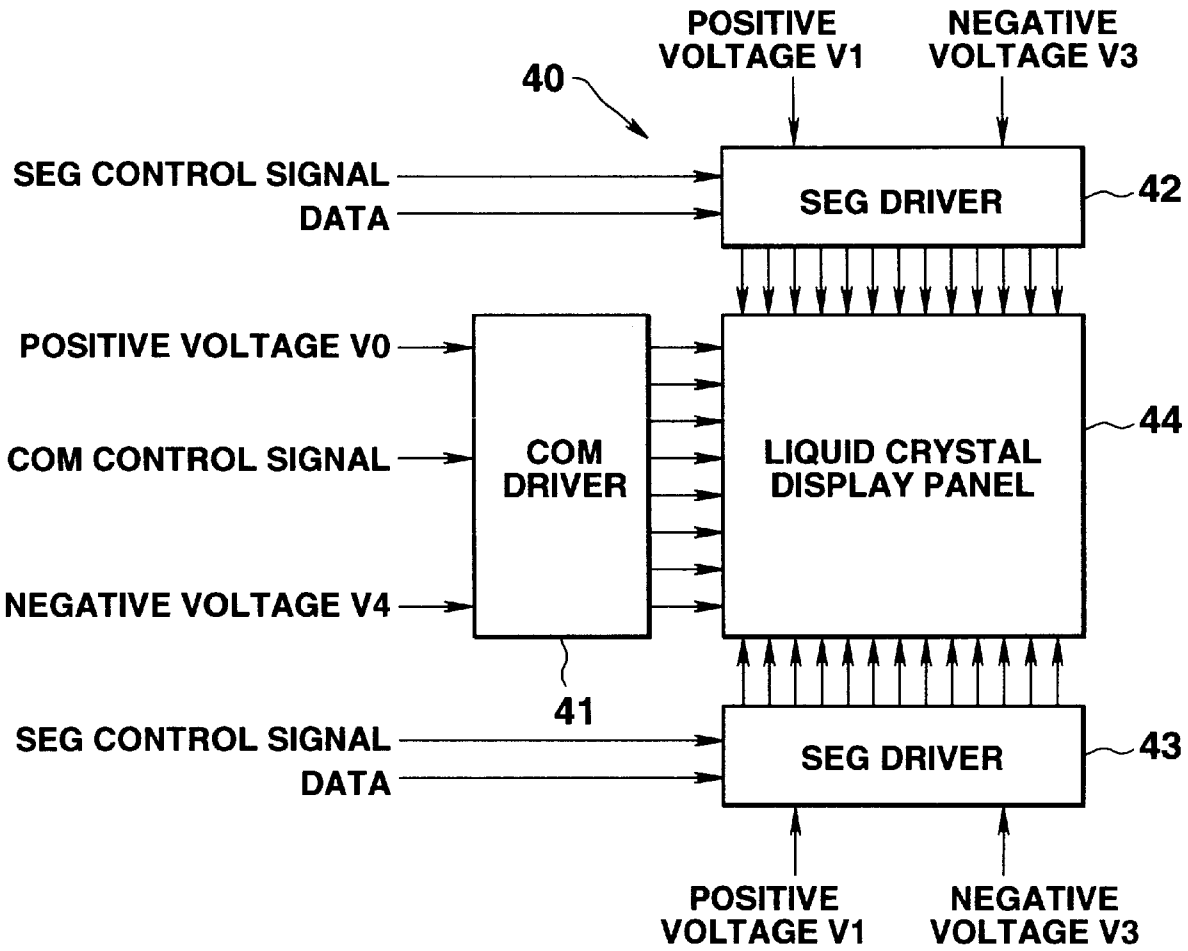
FIG. 15 is a block diagram showing the structure of the main part of a liquid crystal display apparatus 40 according to the second embodiment of the present invention.

FIG. 15 is a block diagram showing the structure of the main part of the liquid crystal display apparatus 40 according to the second embodiment of the present invention. In FIG. 15, the liquid crystal display apparatus 40 includes a COM driver 41 for driving scanning electrodes, SEG drivers 42 and 43 for driving signal electrodes, and a liquid crystal display panel 44. The liquid crystal display panel 44 has a 10×10-dot size.

Figure 16:
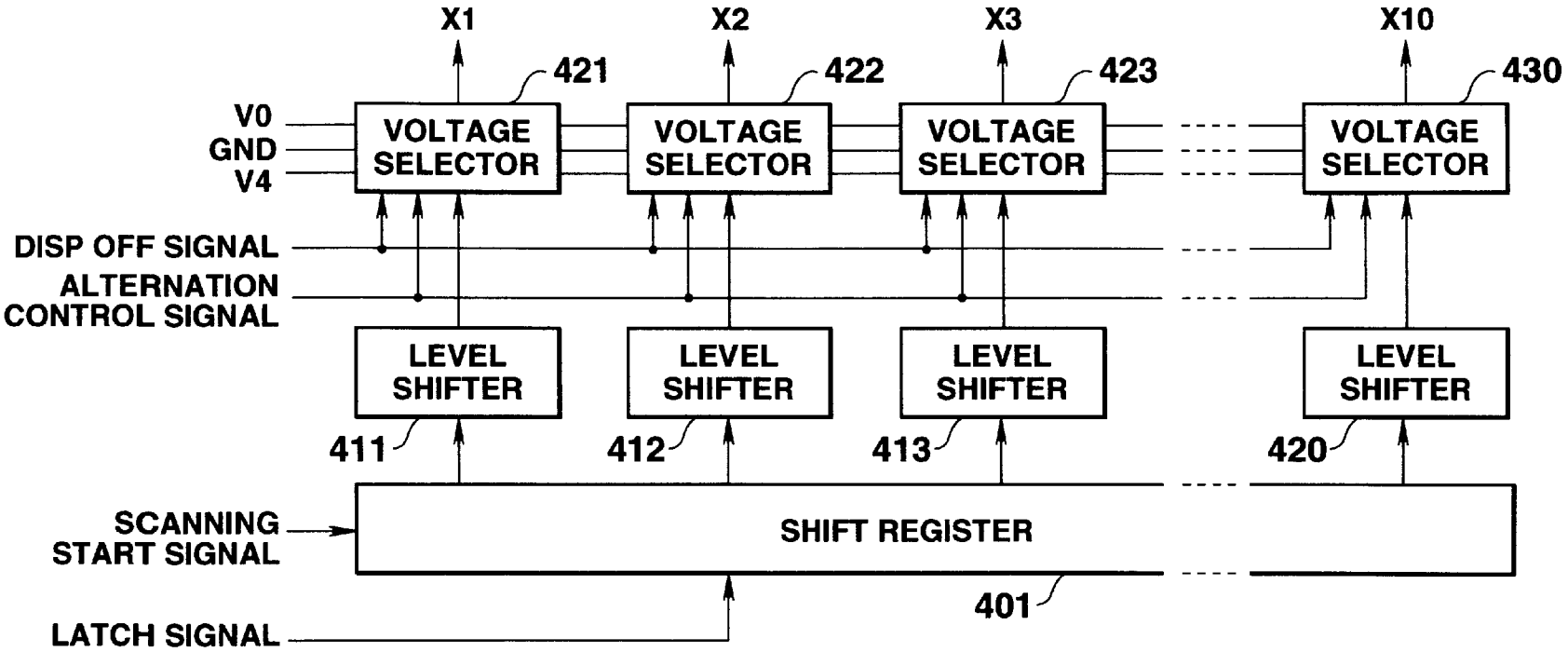
FIG. 16 is a diagram showing the structure of the internal circuitry of a COM driver 41 illustrated in FIG. 15.

As shown in FIG. 16, the COM driver 41 includes a shift register 401, level shifters 411 to 420 and voltage selectors 421 to 430. A liquid crystal drive power source (not shown) applies a positive drive voltage V0 and a negative drive voltage V4 as drive power source voltages to the COM driver 41. A controller (not shown) inputs COM control signals (a latch signal, a scanning start signal, an alternation control signal and a DISP OFF signal) to the COM driver 41.

The shift register 401 latches scanning start signals input from the controller, in response to the latch signal. The shift register 401 shifts the latched signals one per scanning electrode, and outputs them to the level shifters 411 to 420. The level shifters 411 to 420 convert the scanning start signals input from the shift register 401 to a liquid crystal drive voltage level, and output the resultant signals to the voltage selectors 421 to 430. The voltage selectors 421 to 430 sequentially select either the positive drive voltage V0 or the negative drive voltage V4 as a COM drive voltage in accordance with the alternation control signal input from the controller, and sequentially drive scanning electrodes X1 to X10.

Furthermore, the voltage selectors 421 to 430 change the COM drive voltage to a GND (ground) level in response to a DISP OFF signal supplied from the controller, thereby turning off the display of an image on the liquid crystal display panel 44.

Figure 17:
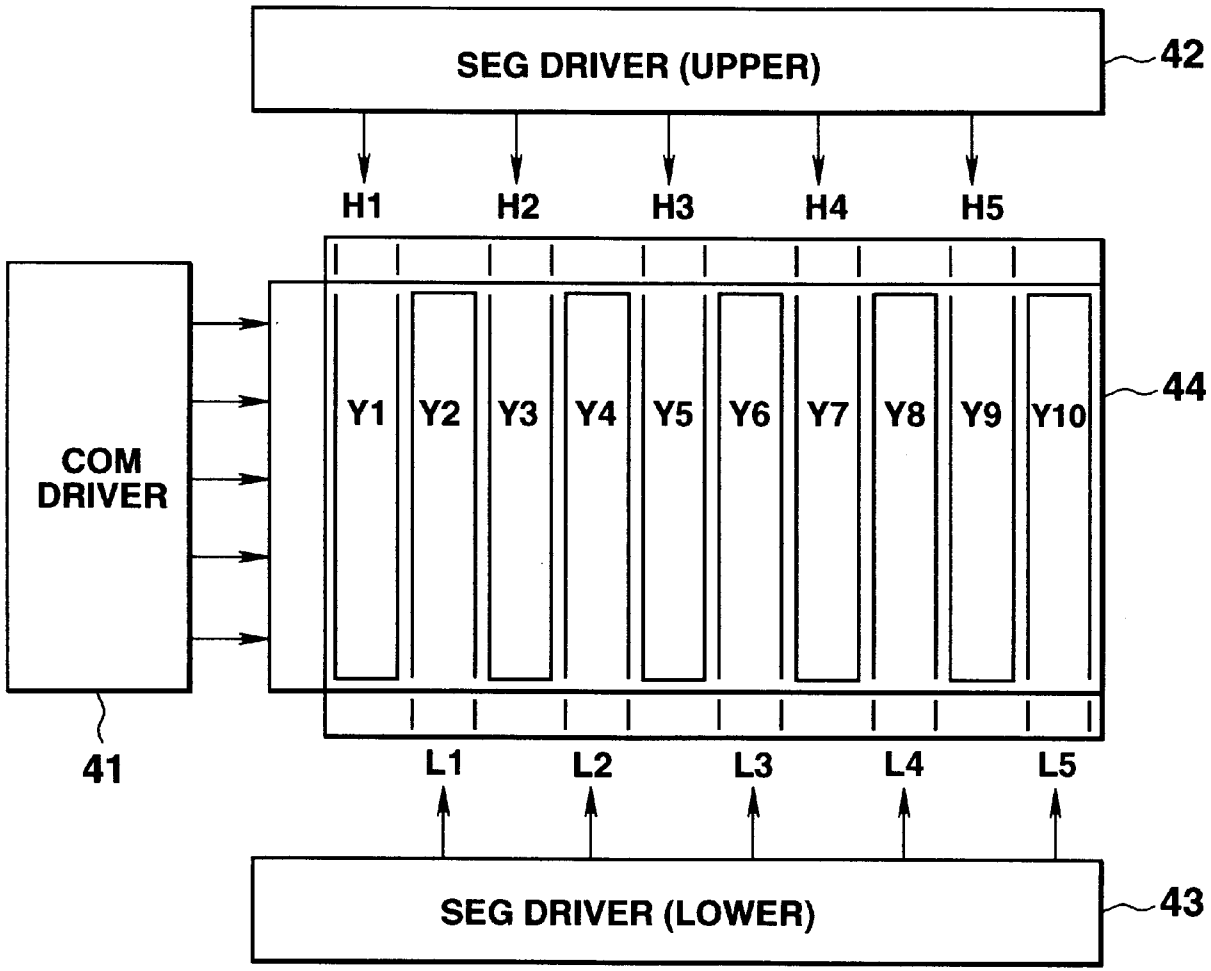
FIG. 17 is a diagram showing the relationship in connection between an SEG driver 42, an SEG driver 43 and signal electrodes of a liquid crystal display panel 44 illustrated in FIG. 15.

As illustrated in FIG. 17, the signal electrodes arranged in the liquid crystal display panel 44 are divided into upper signal electrodes H1 to H5 extending upward and lower signal electrodes L1 to L5 extending downward. The upper signal electrodes H1 to H5 and the lower signal electrodes L1 to L5 are alternate with each other like the teeth of two combs being in mesh with each other. The upper SEG driver 42 drives and controls the upper signal electrodes H1 to H5 (odd-numbered electrodes Y1, Y3, Y5, Y7 and Y9), and the lower SEG driver 43 drives and controls the lower signal electrodes (even-numbered electrodes Y2, Y4, Y6, Y8 and Y10).

Figure 18:
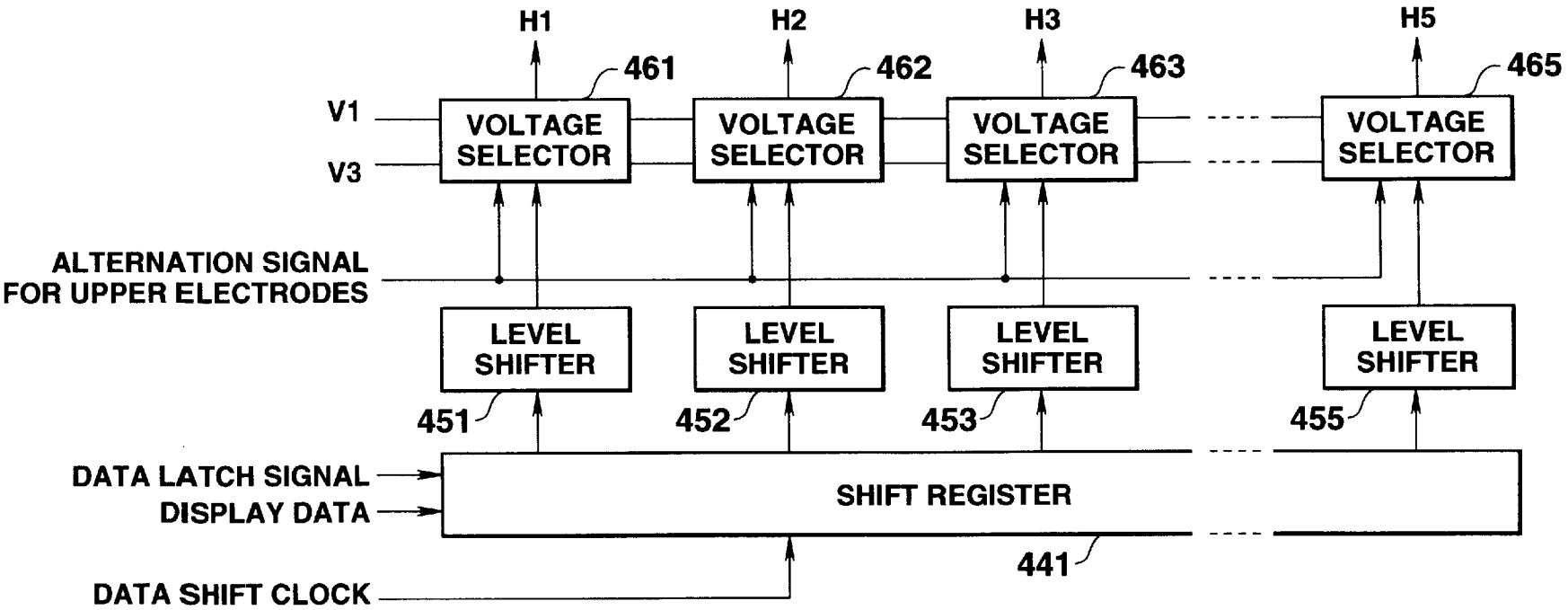
FIG. 18 is a diagram showing the structure of the internal circuitry of the SEG driver 42 illustrated in FIG. 15.

FIG. 18 shows the structure of the internal circuitry of the SEG driver 42. As shown in FIG. 18, the SEG driver 42 includes a shift register 441, level shifters 451 to 455 and voltage selectors 461 to 465. The liquid crystal drive power source (not shown) applies a positive drive voltage V1 and a negative drive voltage V3 as the drive power source voltages to the SEG driver 42. The controller (not shown) inputs SEG control signals (a data shift clock, a data latch signal, an alternation signal for the upper electrodes) and DATA (display data) to the SEG driver 42.

The display data input from the controller is fetched into the shift register 441 in synchronization with the input data shift clock. In response to the data latch signal, the shift register 441 latches the display data for all signal electrodes in time to 1 horizontal scanning period of the signal electrodes, and outputs the latched display data simultaneously to the level shifters 451 to 455. The level shifters 451 to 455 convert the display data for all signal electrodes to the liquid crystal drive voltage level, and outputs the resultant data to the voltage selectors 461 to 465. The voltage selectors 461 to 465 sequentially select either the positive drive voltage V1 or the negative drive voltage V3 in accordance with the alternation signal for the upper electrodes which is input from the controller, and sequentially drive the upper signal electrodes H1 to H5.

Figure 19:
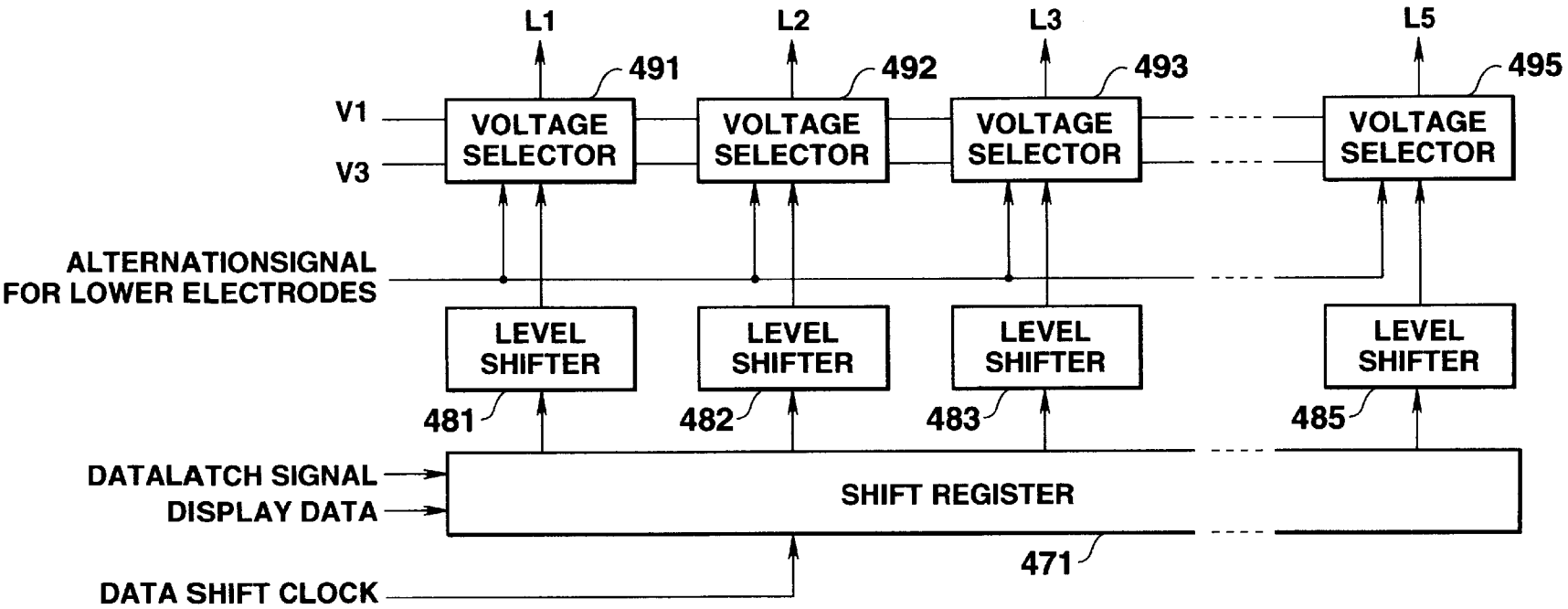
FIG. 19 is a diagram showing the structure of the internal circuitry of the SEG driver 43 illustrated in FIG. 15.

FIG. 19 shows the structure of the internal circuitry of the SEG driver 43. As illustrated in FIG. 19, the SEG driver 43 includes a shift register 471, level shifters 481 to 485 and voltage selectors 491 to 495. The liquid crystal drive power source (not shown) applies the positive drive voltage V1 and the negative drive voltage V3 as the drive power source voltages to the SEG driver 43. The controller (not shown) inputs SEG control signals (a data shift clock, a data latch signal, an alternation signal for the lower electrodes) and DATA (display data) to the SEG driver 43.

The display data input from the controller is fetched into the shift register 471 in synchronization with the input data shift clock. In response to the data latch signal, the shift register 471 latches the display data for all signal electrodes in time to 1 horizontal scanning period of the signal electrodes, and output the latched display data simultaneously to the level shifters 481 to 485. The level shifters 481 to 485 convert the display data for all signal electrodes to the liquid crystal drive voltage level, and outputs the resultant data to the voltage selectors 491 to 495. The voltage selectors 491 to 495 sequentially select either the positive drive voltage V1 or the negative drive voltage V3 in accordance with the alternation signal for the lower electrodes which is input from the controller, and sequentially drive the upper signal electrodes L1 to L5.

The operation of the liquid crystal display apparatus according to the second embodiment will now be described.

In the COM driver 41, the shift register 401 latches scanning start signals input from the controller, in response to the latch signal. The shift register 401 shifts the latched signals one for each of the scanning electrodes X1 to X10, and outputs them to the level shifters 411 to 420. The level shifters 411 to 420 convert the scanning start signals input from the shift register 401 to the liquid crystal drive voltage level, and output the resultant signals to the voltage selectors 421 to 430. The voltage selectors 421 to 430 sequentially select either the positive drive voltage V0 or the negative drive voltage V4 as the COM drive voltage in accordance with the alternation control signal (a) shown in FIG. 5 and input from the controller, and sequentially output the selected voltage. The scanning electrodes X1 to X10 are sequentially driven by an alternation signal, as shown in (b) to (e) of FIG. 5.

When the DISP OFF signal (b) shown in FIG. 6 is input from the controller, the COM driver 41 compulsorily sets the COM drive voltage at the GND (ground) level, thereby turning off the display of an image on the liquid crystal display panel 44.

The display data (DATA) shown as (c) in FIG. 7 and input from the controller is fetched into the shift register 441 of the SEG driver 42 in synchronization with the input data shift clock. In response to the data latch signal, the shift register 441 latches the display data for all signal electrodes in time to 1 horizontal scanning period of the signal electrodes, and output the latched display data simultaneously to the level shifters 451 to 455. The level shifters 451 to 455 convert display data for the upper signal electrodes to the liquid crystal drive voltage level, and output the resultant signals to the voltage selectors 461 to 465. The voltage selectors 461 to 465 sequentially select either the positive drive voltage V1 or the negative drive voltage V3 in accordance with the alternation signal for the upper electrodes. This alternation signal corresponds to the alternation signal (a) which is shown in FIG. 7 as one for the odd-numbered electrodes and which is input from the controller. The voltage selectors 461 to 465 drive the upper electrodes H1 to H5 in such a pattern as is shown in (d) of FIG. 7.

The display data (DATA) shown in (c) of FIG. 7 and input from the controller is fetched into the shift register 471 of the SEG driver 43 in synchronization with the input data shift clock. In response to the data latch signal, the shift register 471 latches the display data for all signal electrodes in time to 1 horizontal scanning period of the signal electrodes, and outputs the latched display data simultaneously to the level shifters 481 to 485. The level shifters 481 to 485 convert display data for the upper signal electrodes to the liquid crystal drive voltage level, and outputs the resultant signals to the voltage selectors 491 to 495. The voltage selectors 491 to 495 sequentially select either the positive drive voltage V1 or the negative drive voltage V3 in accordance with the alternation signal for the lower electrodes. This alternation signal corresponds to the alternation signal (b) which is shown in FIG. 7 as one for the even-numbered electrodes and which is input from the controller. The voltage selectors 491 to 495 drive the lower electrodes L1 to L5 in such a pattern as is shown in (e) of FIG. 7.

Thus, in the liquid crystal display apparatus 40 of the second embodiment, the signal electrodes arranged in the liquid crystal display panel 44 extend alternately upward and downward. The electrodes extending upward are used as the upper signal electrodes H1 to H5, to which the SEG driver 42 is connected. The electrodes extending downward are used as the lower signal electrodes L1 to L5, to which the SEG driver 43 is connected. The alternation signal for the upper electrodes and the alternation signal for the lower electrodes are input respectively to the SEG drivers 42 and 43 so as to drive and control the signal electrodes as does the SEG driver 3 of the first embodiment. By virtue of the above-describe structures, the amount of variation due to the spikes in the effective value of a voltage applied to the liquid crystal can be reduced so as to reduce the crosstalk, and the circuit structure of the SEG drivers 42 and 43 can be simplified.

By thus reducing the crosstalk, the quality of an image which is displayed on the liquid crystal display apparatus 40 is improved.

Furthermore, as mentioned above, in the liquid crystal display apparatus 40 of the second embodiment, the upper signal electrodes H1 to H5 and the lower electrodes L1 to L5 are arranged alternately with each other in the liquid crystal display panel 44, and in accordance with this arrangement, the SEG drivers 42 and 43 are arranged respectively above and below the liquid crystal display panel 44. According to those arrangements, only one kind of alternation signal is input to each driver. Under this condition, the internal circuitry structure of the SEG drivers 42 and 43 is simpler than that of the SEG driver 3 which is arranged on one side of the liquid crystal display panel 4 and which receives two kinds of alternation signals, and the area which is occupied by the SEG drivers 42 and 43 when mounted on a chip is smaller accordingly.

In the liquid crystal display apparatus 40 of the second embodiment, signals corresponding to two kinds of alternation signals shown in FIG. 7, i.e., the alternation signal for the odd-numbered electrodes and the alternation signals for the even-numbered electrodes, are employed as the alternation signal for the upper electrodes and the alternation signal for the lower electrodes. However, the alternation signals are not limited thereto, and other alternation signals such as those shown in FIG. 14, for example, can also be employed.

Third Embodiment

FIGS. 20 to 25 are diagrams showing a liquid crystal display apparatus according to the third embodiment of the present invention.

The structure of the apparatus will be described at first.

Figure 20:
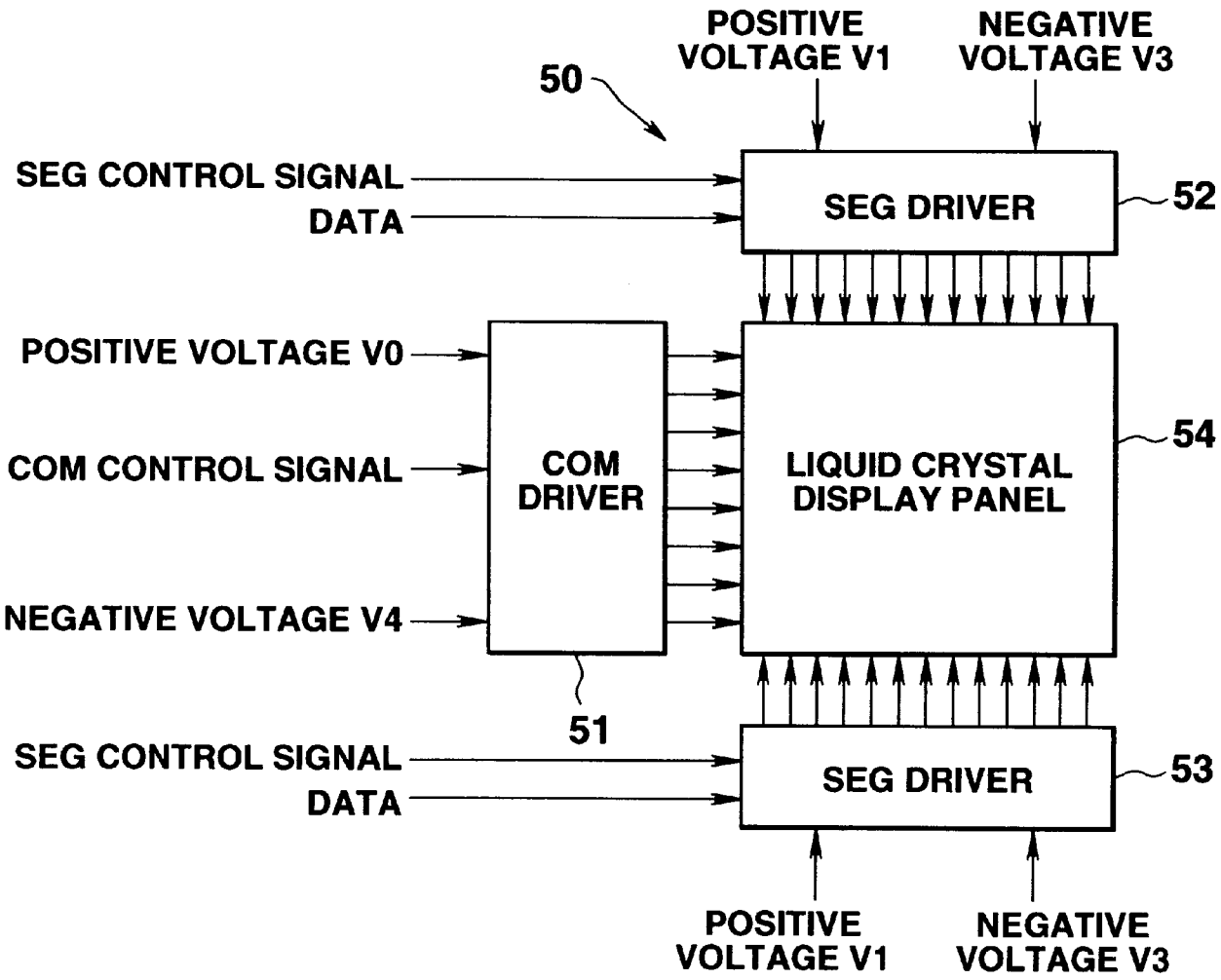
FIG. 20 is a block diagram showing the structure of the main part of a liquid crystal display apparatus according to the third embodiment of the present invention.

FIG. 20 is a block diagram showing the structure of the main part of the liquid crystal display apparatus 50 according to the third embodiment of the present invention. In FIG. 20, the liquid crystal display apparatus 50 includes a COM driver 51 for driving scanning electrodes, SEG drivers 52 and 53 for driving signal electrodes, and a liquid crystal display panel 54.

The liquid crystal display panel 54 has a 10×10-dot size.

Figure 21:
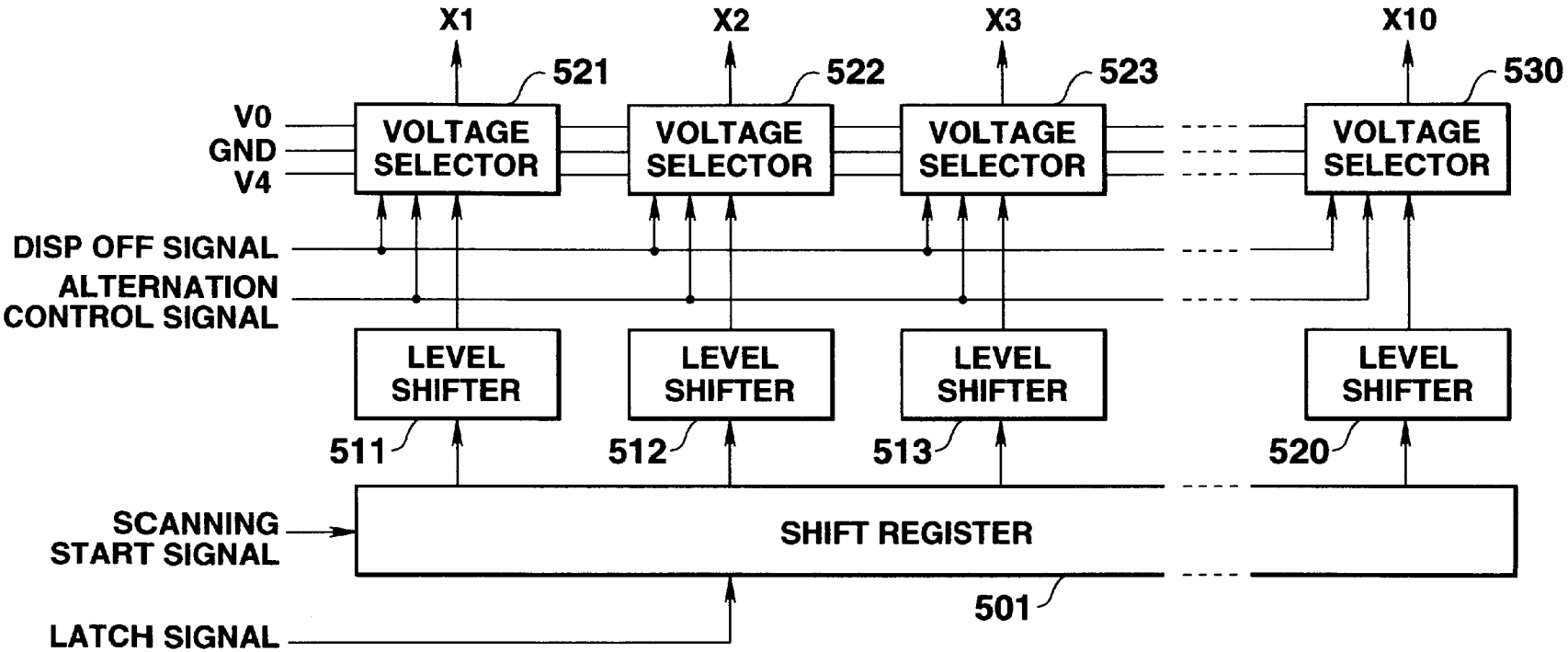
FIG. 21 is a diagram showing the structure of the internal circuitry of a COM driver 51 illustrated in FIG. 20.

As shown in FIG. 21, the COM driver 51 includes a shift register 501, level shifters 511 to 520 and voltage selectors 521 to 530. A liquid crystal drive power source (not shown) applies a positive drive voltage V0 and a negative drive voltage V4 as drive power source voltages to the COM driver 51. A controller (not shown) inputs COM control signals (a latch signal, a scanning start signal, an alternation control signal and a DISP OFF signal) to the COM driver 51.

The shift register 501 latches scanning start signals input from the controller, in response to the latch signal. The shift register 501 shifts the latched signals one per scanning electrode, and outputs them to the level shifters 511 to 520. The level shifters 511 to 520 convert the scanning start signals input from the shift register 501 to a liquid crystal drive voltage level, and output the resultant signals to the voltage selectors 521 to 530. The voltage selectors 521 to 530 sequentially select either the positive drive voltage V0 or the negative drive voltage V4 as a COM drive voltage in accordance with the alternation control signal input from the controller, and sequentially drive scanning electrodes X1 to X10.

Furthermore, the voltage selectors 521 to 530 change the COM drive voltage to a GND (ground) level in response to a DISP OFF signal supplied from the controller, thereby turning off the display of an image on the liquid crystal display panel 54.

Figure 22:
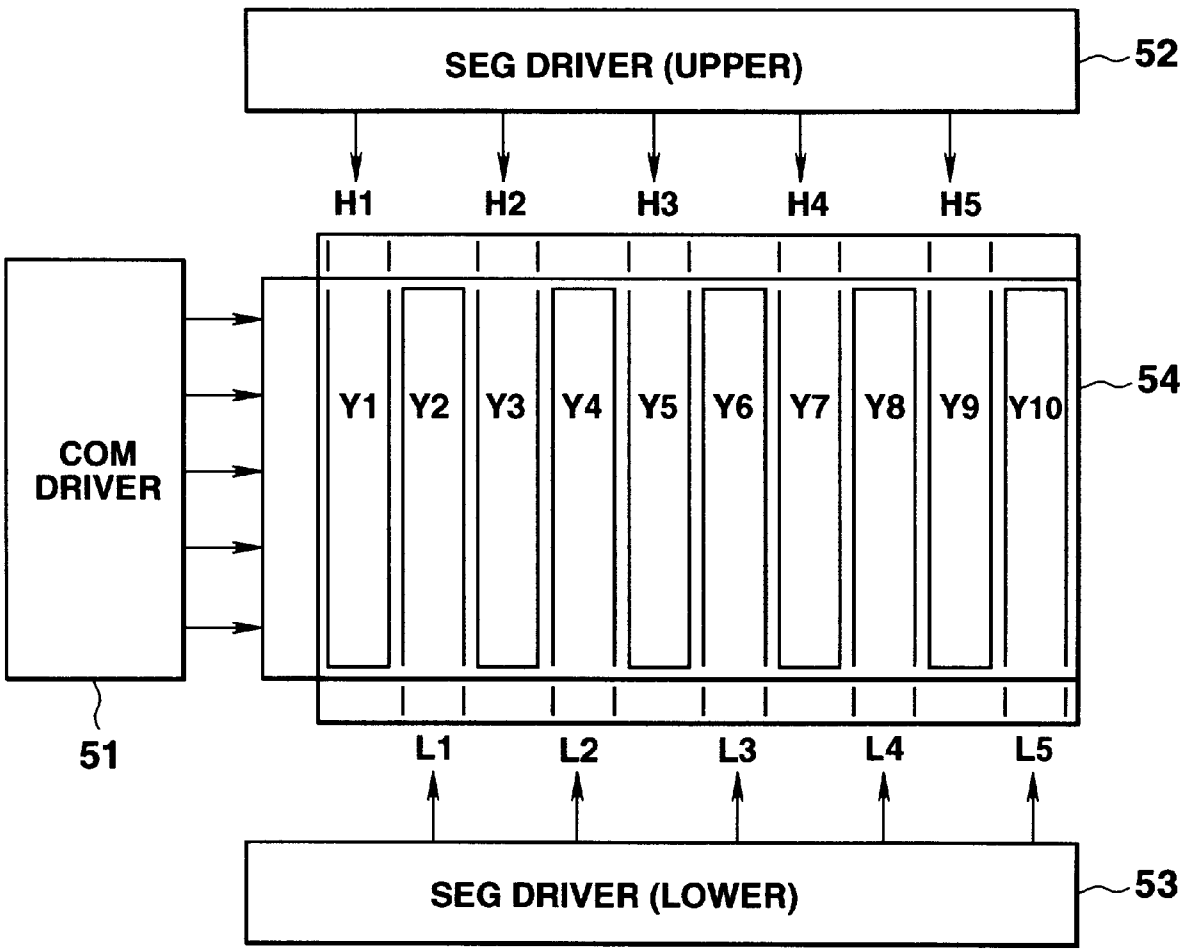
FIG. 22 is a diagram showing the relationship in connection between an SEG driver 52, an SEG driver 53 and signal electrodes of a liquid crystal display panel 54 illustrated in FIG. 20.

As illustrated in FIG. 22, the signal electrodes arranged in the liquid crystal display panel 54 are divided into upper signal electrodes H1 to H5 extending upward and lower signal electrodes L1 to L5 extending downward. The upper signal electrodes H1 to H5 and the lower signal electrodes L1 to L5 are alternate with each other like the teeth of two combs being in mesh with each other. The upper SEG driver 52 drives and controls the upper signal electrodes H1 to H5 (odd-numbered electrodes Y1, Y3, Y5, . . . ), and the lower SEG driver 53 drives and controls the lower signal electrodes L1 to L5 (even-numbered electrodes Y2, Y4, Y6, . . . ).

Figure 23:
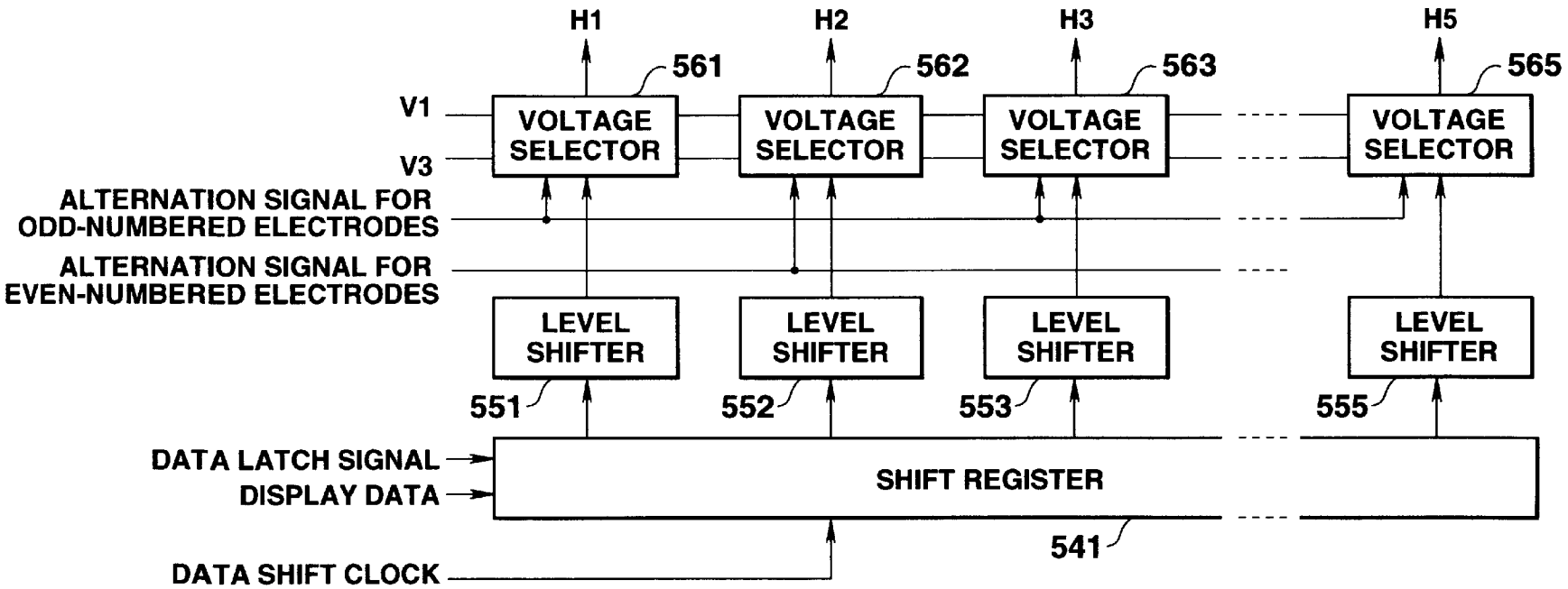
FIG. 23 is a diagram showing the structure of the internal circuitry of the SEG driver 52 illustrated in FIG. 20.

FIG. 23 shows the structure of the internal circuitry of the SEG driver 52. As shown in FIG. 23, the SEG driver 52 includes a shift register 551, level shifters 551 to 555 and voltage selectors 561 to 565. The liquid crystal drive power source (not shown) applies a positive drive voltage V1 and a negative drive voltage V3 as the drive power source voltages to the SEG driver 52. The controller (not shown) inputs SEG control signals (a data shift clock, a data latch signal, an alternation signal for the odd-numbered electrodes and an alternation signal for the even-numbered electrodes) and DATA (display data) to the SEG driver 52.

The display data input from the controller is fetched into the shift register 541 in synchronization with the input data shift clock. In response to the data latch signal, the shift register 551 latches the display data for all signal electrodes in time to 1 horizontal scanning period of the signal electrodes, and outputs the latched display data simultaneously to the level shifters 551 to 555. The level shifters 551 to 555 convert the display data for all signal electrodes to the liquid crystal drive voltage level, and outputs the resultant data to the voltage selectors 561 to 565. The voltage selectors 561 to 565 sequentially select either the positive drive voltage V1 or the negative drive voltage V3 in accordance with the alternation signal for the odd-numbered electrodes which is input from the controller, and sequentially drive the upper odd-numbered electrodes H1, H3 and H5. Moreover, the voltage selectors 561 to 565 sequentially select either the positive drive voltage VI or the negative drive voltage V3 in accordance with the alternation signal for the even-numbered electrodes which is input from the controller, and sequentially drive the upper even-numbered electrodes H2 and H4.

Figure 24:
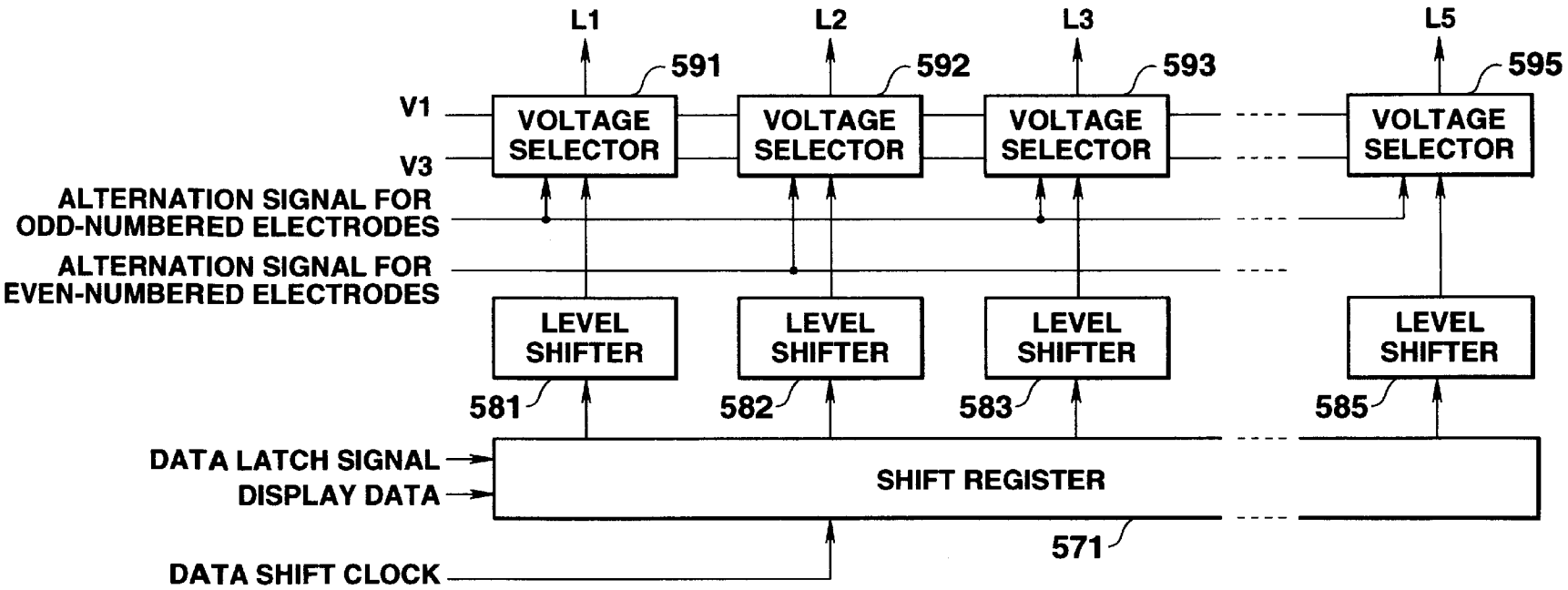
FIG. 24 is a diagram showing the structure of the internal circuitry of the SEG driver 53 illustrated in FIG. 20.

FIG. 24 shows the structure of the internal circuitry of the SEG driver 53. As illustrated in FIG. 24, the SEG driver 53 includes a shift register 571, level shifters 581 to 585 and voltage selectors 591 to 595. The liquid crystal drive power source (not shown) applies the positive drive voltage V1 and the negative drive voltage V3 as the drive power source voltages to the SEG driver 53. The controller (not shown) inputs SEG control signals (a data shift clock, a data latch signal, an alternation signal for the odd-numbered electrodes and an alternation signal for the even-numbered electrodes) and DATA (display data) to the SEG driver 53.

The display data input from the controller is fetched into the shift register 571 in synchronization with the input data shift clock. In response to the data latch signal, the shift register 571 latches the display data for all signal electrodes in time to 1 horizontal scanning period of the signal electrodes, and outputs the latched display data simultaneously to the level shifters 581 to 585. The level shifters 581 to 585 convert the display data for all signal electrodes to the liquid crystal drive voltage level, and outputs the resultant data to the voltage selectors 591 to 595. The voltage selectors 591 to 595 sequentially select either the positive drive voltage V1 or the negative drive voltage V3 in accordance with the alternation signal for the odd-numbered electrodes which is input from the controller, and sequentially drive the lower odd-numbered signal electrodes L1, L3 and L5. Moreover, the voltage selectors 591 to 595 sequentially select either the positive drive voltage V1 or the negative drive voltage v3 in accordance with the alternation signal for the even-numbered electrodes, and sequentially drive the lower even-numbered signal electrodes L2 and L4.

The SEG drivers 52 and 53 receives the same alternation signal for the odd-numbered electrodes and the same alternation signal for the eve-numbered electrodes.

The operation of the liquid crystal apparatus according to the third embodiment will now be described.

In the COM driver 51, the shift register 501 latches scanning start signals input from the controller, in response to the latch signal. The shift register 501 shifts the latched signals one for each of the scanning electrodes X1 to X10, and outputs them to the level shifters 511 to 520. The level shifters 511 to 520 convert the scanning start signals input from the shift register 501 to the liquid crystal drive voltage level, and output the resultant signals to the voltage selectors 521 to 530. The voltage selectors 521 to 530 sequentially select either the positive drive voltage V0 or the negative drive voltage V4 as the COM drive voltage in accordance with the alternation control signal (a) shown in FIG. 5 and input from the controller, and sequentially output the selected voltage. The scanning electrodes X1 to X10 are sequentially driven by an alternation signal, as shown in (b) to (e) of FIG. 5.

When the DISP OFF signal (b) shown in FIG. 6 is input from the controller, the COM driver 51 compulsorily sets the COM drive voltage at the GND (ground) level, thereby turning off the display of an image on the liquid crystal display panel 54.

The operations of the SEG drivers 52 and 53 will now be described with reference to the timing chart shown in FIG. 25.

Figure 25:
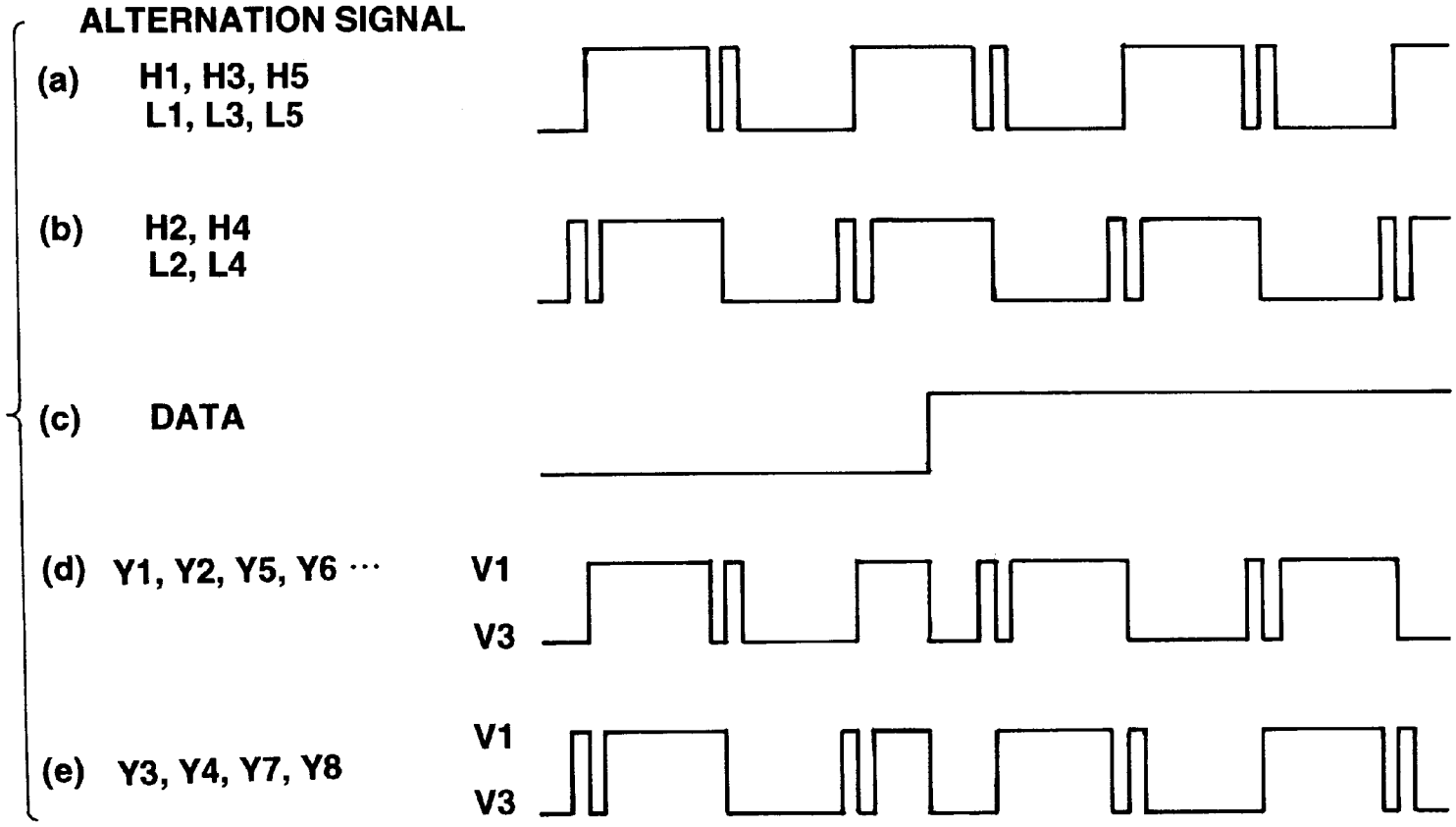
FIG. 25 is a timing chart for explaining the operations of the SEG drivers 52 and 53 illustrated in FIG. 20.

In FIG. 25, (a) shows an alternation signal for a group of odd-numbered electrodes; (b) shows an alternation signal for a group of even-numbered electrodes; (c) shows display data (DATA), (d) indicates SEG drive signals for driving the signal electrodes Y1, Y2, Y5, Y6 . . . belonging to the group of the odd-numbered electrodes; and (e) shows SEG drive signals for driving the signal electrodes Y3, Y4, Y7, Y8 belonging to the group of the even-numbered electrodes.

The display data (DATA), shown in (c) of FIG. 25 and input from the controller, is fetched into the shift register 541 of the SEG driver 52 in synchronization with the input data shift clock. In response to the data latch signal, the shift register 541 latches the display data for all signal electrodes in time to 1 horizontal scanning period of the signal electrodes, and outputs the latched display data simultaneously to the level shifters 551 to 555. The level shifters 551 to 555 convert the display data for all signal electrodes to the liquid crystal drive voltage level, and output the resultant signals to the voltage selectors 561 to 565.

The voltage selectors 561 to 565 sequentially select either the positive drive voltage V1 or the negative drive voltage V3 in accordance with the alternation signal (a) which is shown in FIG. 25 as one for the group of the odd-numbered electrodes and which is input from the controller, and drive the upper odd-numbered signal electrodes H1, H3 and H5, i.e., the signal electrodes Y1, Y5 and Y9 which belong to the group of the odd-numbered electrodes, as shown in (d) of FIG. 25. Further, the voltage selectors 561 to 565 sequentially select either the positive drive voltage V1 or the negative drive voltage V3 in accordance with the alternation signal (b) which is shown in FIG. 25 as one for the group of the even-numbered electrodes and which is input from the controller, and drive the upper even-numbered signal electrodes H2 and H4, i.e., the signal electrodes Y3 and Y7 which belong to the group of the even-numbered electrodes, as shown in (e) of FIG. 25.

The display data (DATA), shown in (c) of FIG. 25 and input from the controller, is fetched into the shift register 571 of the SEG driver 53 in synchronization with the input data shift clock. In response to the data latch signal, the shift register 571 latches the display data for all signal electrodes in time to 1 horizontal scanning period of the signal electrodes, and outputs the latched display data simultaneously to the level shifters 581 to 585. The level shifters 581 to 585 convert the display data for all signal electrodes to the liquid crystal drive voltage level, and output the resultant signals to the voltage selectors 591 to 595.

The voltage selectors 591 to 595 sequentially select either the positive drive voltage V1 or the negative drive voltage V3 in accordance with the alternation signal (a) which is shown in FIG. 25 as one for the group of the odd-numbered electrodes and which is input from the controller, and drive the lower odd-numbered signal electrodes L1, L3 and L5, i.e., the signal electrodes Y2, Y6 and Y10 which belong to the group of the odd-numbered electrodes, as shown in (d) of FIG. 25. Further, the voltage selectors 591 to 595 sequentially select either the positive drive voltage V1 or the negative drive voltage V3 in accordance with the alternation signal (b) which is shown in FIG. 25 as one for the group of the even-numbered electrodes and which is input from the controller, and drive the lower even-numbered signal electrodes L2 and L4, i.e., the signal electrodes Y4 and Y8 belonging to the group of the even-numbered electrodes, as shown in (e) of FIG. 25.

As illustrated in FIG. 25, the upper signal electrodes H1 to H5 and the lower signal electrodes L1 to L5 are divided into the group of the odd-numbered electrodes and the group of the even-numbered electrodes. Those of the upper and lower signal electrodes which belong to the group of the odd-numbered electrodes are driven in accordance with the alternation signal for the group of the odd-numbered electrodes, while those of the upper and lower signal electrodes which belong to the group of the even-numbered electrodes are driven in accordance with the alternation signal for the group of the even-numbered electrodes. Under those conditions, pairs of adjacent signal electrodes of the upper and lower signal electrodes H1 to H5 and L1 to L5 are driven in accordance with the alternation signals. More specifically, a pair of signal electrodes Y1 and Y2, a pair of signal electrodes Y5 and Y6, and a pair of signal electrodes Y9 and Y10 are driven in accordance with the alternation signal for the group of the odd-numbered electrodes. The signal electrodes Y1, Y2, Y5, Y6, Y9 and Y10 correspond respectively to the upper and lower signal electrodes H1, L1, H3, L3, H5 and L5, all belonging to the group of the odd-numbered electrodes. On the other hand, a pair of signal electrodes Y3 and Y4 and a pair of signal electrodes Y7 and Y8 are driven in accordance with the alternation signal for the group of the even-numbered electrodes. The signal electrodes Y3, Y4, Y7 and Y8 correspond respectively to the upper and lower signal electrodes H2, L2, H4 and L4, all belonging to the group of the even-numbered electrodes.

According to the above-described drive method, the spikes which occur at the time of a change in the level of the SEG drive signals supplied to one pair of signal electrodes are canceled out by the spikes which occur at the time of a change in the level of the SEG drive signals supplied to another adjacent pair of signal electrodes. For example, in the case of a pair of signal electrodes H1 (Y1) and L1 (Y2) and its adjacent pair of signal electrodes H2 (Y3) and L2 (Y4), the spike occurring at the time of a change in the level of the SEG drive signal supplied to the signal electrode H1 (Y1) is canceled out by one occurring at the time of a change in the level of the SEG drive signal supplied to the signal electrode H2 (Y3), while the spike occurring at the time of a change in the level of the SEG drive signal supplied to the signal electrode L1 (Y2) is canceled out by one occurring at the time of a change in the level of the SEG drive signal supplied to the signal electrode L2 (Y4). Similarly in the case of the other pairs of signal electrodes, the spikes occurring when the SEG drive signals change in level cancel out each other as well.

In the above-described structure, the spikes which occur when SEG drive signals supplied from the same driver change in level cancel out each other, under which condition the influences of voltage differences due to a variation in the resistance, which increases within the signal electrodes as the SEG drive signals flow therethrough away from the nodes at which the signal electrodes are connected to the SEG drivers 52 and 53, cancel out each other according to the above drive method.

Specifically, in the upper signal electrodes H1 to H5, the resistance to the SEG drive signals varies as they flow through the electrodes H1 to H5 away from the nodes at which the electrodes H1 to H5 are connected to the SEG driver 52. Similarly, in the lower signal electrodes L1 to L5, the resistance to the SEG drive signals varies as they flow through the electrodes L1 to L5 away from the nodes at which the electrodes L1 to L5 are connected to the SEG driver 53. Due to a variation in the resistance, a potential difference occurs in each SEG drive signal. The influences of such potential differences upon the spikes do not cancel out each other according to a drive method like that of the second embodiment. However, according to the drive method of the third embodiment using signal electrodes forming adjacent pairs, those influences cancel out each other.

Thus, in the liquid crystal display apparatus 50 of the third embodiment, the signal electrodes in the liquid crystal display panel 54 are divided into the upper signal electrodes and the lower signal electrodes arranged alternately with the upper signal electrodes, and the SEG driver 52 is connected to the upper signal electrodes, while the SEG 53 is connected to the lower signal electrodes. With this structure, the influences of the spikes occurring when driving the signal electrodes in accordance with the alternation signals are assuredly canceled.

This further reduces the crosstalk and ensures a further improved quality of an image which is displayed on the liquid crystal display apparatus 50.

Furthermore, as mentioned above, the signal electrodes in the liquid crystal display panel 54 are divided into the upper signal electrodes H1 to H5 and the lower signal electrodes L1 to L5 arranged alternately with the upper signal electrodes, and the SEG drivers 52 and 53 are connected the former to the upper signal electrodes and the latter to the lower signal electrodes. Under those conditions, the internal circuitry structures of the SEG drivers 42 and 43 are simpler than that of the SEG driver 3 which is arranged on one side of the liquid crystal display panel 4 and which receives two kinds of alternation signals, and the area which is occupied by the SEG drivers 52 and 52 when mounted on a chip is smaller accordingly.

In the liquid crystal display apparatus 50 of the third embodiment, signals shown in FIG. 25 are employed as the alternation signal for the group of the odd-numbered electrodes and that for the group of the even-numbered electrodes. However, the alternation signals are not limited thereto, and other alternation signals may also be employed as the alternation signal for the group of the odd-numbered electrodes and that for the group of the even-numbered electrodes. Moreover, explained in the third embodiment is the case where two kinds of alternation signals, i.e., the alternation signal for the group of the odd-numbered electrodes and the alternation signal for the group of the even-numbered electrodes, are adopted. However, more than two kinds of alternation signals can also be adopted.

Furthermore, according to the first to third embodiments, the liquid crystal display panel is a dot-matrix type display panel including signal electrodes, scanning electrodes crossing over the signal electrodes, and pixel portions formed at the crossings of the signal and scanning electrodes. However, the liquid crystal display panel is not limited thereto, and may be a segment type display panel which includes signal electrodes formed in a predetermined pattern, a common electrode facing the signal electrodes, and pixel portions formed between the common electrode and the signal electrodes, or may be a combination of the dot-matrix type and the segment type.

What is claimed is:

1. A liquid crystal display comprising:

a plurality of signal electrodes;

a plurality of scanning electrodes extending in a direction to cross over said signal electrodes;

pixel portions each comprising of a part of one of said signal electrodes, a part of one of said scanning electrodes and a liquid crystal, said part of one of said signal electrodes and said part of one of said scanning electrodes facing each other with the liquid crystal therebetween;

scanning electrode drive means for sequentially selecting said scanning electrodes by sequentially outputting scanning electrode drive signals in one to one correspondence to said scanning electrodes, each of said scanning electrode drive signals having a set selection period during which a corresponding one of said scanning electrodes is selected, and each of said scanning electrode drive signals having a voltage whose polarity is reversed each time a predetermined period of time passes during the set selection period; and signal electrode drive means for outputting signal electrode drive signals to said signal electrodes and for reversing polarities of voltages of said signal electrode drive signals in accordance with polarity reversal timings of the voltages of said scanning electrode drive signals;

wherein said signal electrode drive means prepares a polarity reversal control area in any one of said signal electrode drive signals to be output to at least adjacent signal electrodes before and after a time of polarity reversal of said scanning electrode drive signals, and comprises control pulses which carry out polarity reversal in accordance with the polarity reversal timings of the voltages of said scanning electrode drive signals in order to reverse the polarities of the voltages of said signal electrode drive signals.

2. The liquid crystal display apparatus according to claim 1, wherein:

two type of alternation signals are input to said signal electrode drive means; and said alternation signals carry out alternate polarity reversals in accordance with the polarity reversal timings of the voltages of said scanning electrode drive signals and comprise control pulses which carry out polarity reversals in a polarity reversal control area, which is prepared in any one of said two kinds of the alternation signals before and after the polarity reversal timings of the voltages of said scanning electrode drive signals, in accordance with the polarity reversal timings of the voltages of said scanning electrode drive signals in order to reverse the polarities of said alternation signals.

3. The liquid crystal display apparatus according to claim 1, wherein:

said scanning electrode drive signals each have a selection period of a predetermined length; and a non-selection period is set between the selection period of each of said scanning electrode drive signals and the selection period of the scanning electrode drive signal which is output to a scanning electrode to be selected next, said non-selection period being two times as long as a width of said control pulses and being a period during which no scanning electrode is selected.

4. The liquid crystal display apparatus according to claim 1, wherein:

said signal electrode drive means includes a pair of signal electrode drivers between which said signal electrodes extend; and said signal electrodes are prolonged in opposite directions alternately and are each connected to a corresponding one of said pair of signal electrode drivers.

5. The liquid crystal display apparatus according to claim 4, wherein:

alternation signals are respectively input to said pair of signal electrode drivers; and said alternation signals carry out alternate polarity reversals in accordance with the polarity reversal timings of the voltages of said scanning electrode drive signals, and have control pulses which carry out polarity reversals in accordance with the polarity reversal timings of the voltages of said scanning electrode drive signals in a polarity reversal control area which is prepared in any one of said alternation signals before and after the polarity reversals of said scanning electrode drive signals, in order to reverse the polarities of said alternation signals.

6. A liquid crystal display apparatus comprising:

first signal electrodes, and second signal electrodes which are alternate with said first signal electrodes, said first and second signal electrodes having connection terminals formed by prolonging end portions of said first and second signal electrodes in opposite directions alternately;

scanning electrodes crossing over said first and second signal electrodes;

pixel portions each comprising of a part of one of said signal electrodes, a part of one of said scanning electrodes and a liquid crystal, said part of one of said signal electrodes and said part of one of said scanning electrodes facing each other with the liquid crystal therebetween;

scanning electrode drive means for sequentially selecting said scanning electrodes by sequentially outputting scanning electrode drive signals in one to one correspondence to said scanning electrodes, each of said scanning electrode drive signals having a set selection period during which a corresponding one of said scanning electrodes is selected, and each of said scanning electrode drive signals having a voltage whose polarity is reversed each time a predetermined period of time passes during the set selection period; and a pair of signal electrode drive means for outputting signal electrode drive signals to said signal electrodes and for reversing polarities of voltages of said signal electrode drive signals in accordance with polarity reversal timings of the voltages of said scanning electrode drive signals;

wherein said pair of signal electrode drive means prepare, before and after a time of polarity reversal of the voltages of said scanning electrode drive signals, a polarity reversal control area in any one of said signal electrode drive signals to be output to at least a pair of adjacent signal electrodes of said first and second signal electrodes extending between said pair of signal electrode drive means, and control pulses which reverse the polarity of the voltages of said signal electrode drive signals in said polarity reversal control area in accordance with the polarity reversal timings of the voltages of said scanning electrode drive signals; and wherein the prolonged end portions of said first signal electrodes are connected to one of said pair of signal electrode drive means, and the prolonged end portions of said second signal electrodes are connected to the other of said pair of signal electrode drive means.

7. The liquid crystal display apparatus according to claim 6, wherein:

two kinds of said alternation signals are input to each of said signal electrode drive means, and said alternation signals alternately reverse the polarities of the voltages of said signal electrode drive signals in accordance with the polarity reversal timings of the voltages of said scanning electrode drive signals while having, before and after the time of polarity reversal of said scanning electrode drive signals, a polarity reversal control area in any one of said two kinds of alternation signals; and said alternation signals comprise pulse signals having control pulses which reverse polarities of voltages of said alternation signals in said polarity reversal control area in accordance with the polarity reversal timings of the voltages of said scanning electrode drive signals.

8. The liquid crystal display apparatus according to claim 7, wherein:

said scanning electrode drive signals each have a selection period of a predetermined length; and a non-selection period is set between the selection period of each of said scanning electrode drive signals and the selection period of the scanning electrode drive signal which is output to a scanning electrode to be selected next, said non-selection period being two times as long as a width of said control pulses and being a period during which no scanning electrode is selected.

9. A liquid crystal display apparatus comprising:

a liquid crystal panel which includes signal electrodes, scanning electrodes crossing over said signal electrodes, and pixel portions arranged in a matrix pattern at crossings of said signal electrodes and said scanning electrodes, each of said pixel portions comprising a liquid crystal and a pair of electrodes facing each other with the liquid crystal therebetween;

scanning electrode drive means for sequentially selecting said scanning electrodes by sequentially outputting scanning electrode drive signals in one to one correspondence to said scanning electrodes, each of said scanning electrode drive signals having a set selection period during which a corresponding one of said scanning electrodes is selected, and each of said scanning electrode drive signals having a voltage whose polarity is reversed each time a predetermined period of time passes during the set selection period; and signal electrode drive means for outputting signal electrode drive signals to said signal electrodes and for reversing polarities of voltages of said signal electrode drive signals in accordance with polarity reversal timings of the voltages of said scanning electrode drive signals;

wherein said signal electrode drive means prepares, before and after the polarity reversal timings of the voltages of said scanning electrode drive signals, a polarity reversal control area in any one of said signal electrode drive signals to be applied to at least a pair of signal electrodes of said signal electrodes, and comprises control pulses which carry out polarity reversals in said polarity reversal control area in accordance with the polarity reversal timings of the voltages of said scanning electrode drive signals.

10. A drive method for driving a liquid crystal display apparatus, comprising:

preparing a liquid crystal display element which comprises signal electrodes, scanning electrodes crossing over said signal electrodes, and pixel portions, each of said pixel portions comprising a part of one of said signal electrodes, a part of one of said scanning electrodes and a liquid crystal, said part of one of said signal electrodes and said part of one of said scanning electrodes facing each other with the liquid crystal therebetween;

sequentially selecting said scanning electrodes by sequentially outputting scanning electrode drive signals in one to one correspondence to said scanning electrodes, each of said scanning electrode drive signals having a set selection period during which a corresponding one of said scanning electrodes is selected, and each of said scanning electrode drive signals having a voltage whose polarity is reversed each time a predetermined period of time passes during the set selection period; and outputting a pair of signal electrode drive signals to at least any one of a pair of signal electrodes of said signal electrodes before and after polarity reversals of the voltages of said scanning electrode drive signals during selection periods to be output to said scanning electrodes, respectively, said pair of signal electrode drive signals having a polarity reversal control area and control pulses which reverse polarities of voltages of said signal electrode drive signals in accordance with polarity reversal timings of the voltages of said scanning electrode drive signals.

11. The drive method according to claim 10, wherein:

said pair of signal electrode drive signals are formed based on two kinds of alternation signals; and said two kinds of alternation signals comprise pulse signals having control pulses which carry out polarity reversal in accordance with the polarity reversal timings of the voltages of said scanning electrode drive signal in a polarity reversal control area which is prepared in any one of said alternation signals before and after a time of reversal of the polarities of the voltages of said scanning electrode drive signals in order to reverse the polarities of said alternation signals.

12. The drive method according to claim 10, wherein:

said scanning electrode drive signals each have a selection period of a predetermined length;

said scanning electrode drive signals are output sequentially to said scanning electrodes; and a non-selection period is set between the selection period of each of said scanning electrode drive signals and the selection period of the scanning electrode drive signal which is output to a scanning electrode to be selected next, said non-selection period being two times as long as a width of said control pulses and being a period during which no scanning electrode is selected.

* * * * *

UNITED STATES PATENT AND TRADEMARK OFFICE

CERTIFICATE OF CORRECTION

PATENT NO. :6,124,852

DATED :September 26, 2000

INVENTOR(S) :Koji YAMAGASHI et al.

It is certified that error appears in the above-indentified patent and that said Letters Patent is hereby corrected as shown below:

Titlé page,

Item [75] Inventors, line 3, change "Nakada" to --Harada--.

Signed and Sealed this

First Day of May, 2001

*Attest:*

Nicholas P. Godici

NICHOLAS P. GODICI

*Attesting Officer*

*Acting Director of the United States Patent and Trademark Office*